US011486337B2

(12) United States Patent
Haaland et al.

(10) Patent No.: US 11,486,337 B2
(45) Date of Patent: Nov. 1, 2022

(54) INTEGRATED EXHAUST SYSTEM APPARATUS

(71) Applicant: Deere & Company, Moline, IL (US)

(72) Inventors: Eric J. Haaland, Waverly, IA (US); Veeresh Nagathan, Waterloo, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 16/563,308

(22) Filed: Sep. 6, 2019

(65) Prior Publication Data

US 2021/0071623 A1 Mar. 11, 2021

(51) Int. Cl.
*F02M 26/32* (2016.01)

(52) U.S. Cl.
CPC ..... *F02M 26/32* (2016.02)

(58) Field of Classification Search
CPC ..... F02M 26/32; F28D 21/0003; F28F 1/126; F02B 29/0437
USPC ..... 123/568.12; 165/52
See application file for complete search history.

(56) References Cited

U.S. PATENT DOCUMENTS 6,360,532 B2 * 3/2002 Strahle ..... F28D 9/0037 123/568.12
2002/0005190 A1 * 1/2002 Bianchi ..... F02M 26/31 123/568.13
2006/0207578 A1 * 9/2006 Gallino ..... F02M 26/26 123/568.12
2007/0039571 A1 * 2/2007 Redon ..... F02M 35/10288 123/41.31
2008/0223563 A1 * 9/2008 Penny ..... B21D 53/04 29/890.035

(Continued)

FOREIGN PATENT DOCUMENTS

CN 2740989 Y 11/2005
CN 201011324 Y 1/2008

(Continued)

OTHER PUBLICATIONS

German Search Report issued in counterpart application No. 102020210707.6 dated Apr. 14, 2021 (10 pages).

*Primary Examiner* — Logan M Kraft
*Assistant Examiner* — Joshua Campbell
(74) *Attorney, Agent, or Firm* — Klintworth & Rozenblat IP LLP

(57) ABSTRACT

An integrated exhaust system apparatus to be mounted on an engine is provided. The apparatus includes an apparatus housing; an engine interface; an exhaust system interface with a first exhaust apparatus outlet configured to direct a first portion of exhaust through the housing wall; an EGR interface with a second exhaust apparatus outlet configured to direct a second portion of exhaust through the apparatus housing wall; and an exhaust manifold arranged within the apparatus interior. The exhaust manifold includes a first manifold outlet configured to direct the first portion of exhaust out of the manifold interior and a second manifold outlet configured to direct the second portion of exhaust out of the manifold interior. An EGR cooler is arranged within the apparatus interior with passages fluidly coupled such that the second portion of exhaust is directed out of the apparatus housing via the second exhaust apparatus outlet.

18 Claims, 12 Drawing Sheets

(56) References Cited

U.S. PATENT DOCUMENTS

| | | | | |
|---|---|---|---|---|
| 2011/0185714 | A1* | 8/2011 | Lohbreyer | F28F 9/26 60/320 |
| 2011/0247318 | A1* | 10/2011 | Kuroyanagi | F28F 9/001 60/278 |
| 2014/0345579 | A1* | 11/2014 | Keppy | F02M 26/30 123/568.12 |
| 2015/0226108 | A1* | 8/2015 | Vroman | F02B 29/0437 60/605.2 |
| 2015/0308388 | A1* | 10/2015 | Castaño Gonzalez | F02M 26/29 123/568.12 |
| 2017/0002772 | A1* | 1/2017 | Perfetto | F02B 37/001 |
| 2017/0009708 | A1* | 1/2017 | Janke | F28D 7/16 |
| 2017/0306797 | A1* | 10/2017 | Tennevall | F01D 25/243 |
| 2019/0186361 | A1* | 6/2019 | Gerstler | F28D 9/04 |

FOREIGN PATENT DOCUMENTS

| | | | | |
|---|---|---|---|---|
| CN | 101307736 | B | 11/2008 | |
| CN | 201258798 | Y | 6/2009 | |
| CN | 201258801 | Y | 6/2009 | |
| CN | 201311217 | Y | 9/2009 | |
| CN | 201503235 | U | 6/2010 | |
| CN | 201653235 | U | 11/2010 | |
| CN | 201786439 | U | 4/2011 | |
| CN | 201786441 | U | 4/2011 | |
| CN | 201970072 | U | 9/2011 | |
| CN | 202039976 | U | 11/2011 | |
| CN | 102278241 | B | 12/2011 | |
| CN | 202132100 | U | 2/2012 | |
| CN | 202132132 | U | 2/2012 | |
| CN | 202209898 | U | 5/2012 | |
| CN | 202452872 | U | 9/2012 | |
| CN | 202611933 | U | 12/2012 | |
| CN | 202707289 | U | 1/2013 | |
| CN | 202836318 | U | 3/2013 | |
| CN | 203114460 | U | 8/2013 | |
| CN | 203114461 | U | 8/2013 | |
| DE | 102010048793 | B3 | 11/2011 | |
| DE | 102010051562 | A1 | 5/2012 | |
| DE | 102014222725 | A1 | 5/2015 | |
| EP | 2444615 | A1 * | 4/2012 | F01N 13/10 |
| JP | 09126063 | A * | 5/1997 | |
| JP | 6230098 | B2 * | 11/2017 | |

* cited by examiner

INTEGRATED EXHAUST SYSTEM APPARATUS

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure generally relates to work vehicles, and more specifically to power and exhaust systems and methods for a work vehicle.

BACKGROUND OF THE DISCLOSURE

Heavy work vehicles, such as used in the construction, agriculture and forestry industries, typically include a power system with an internal combustion engine in the form of a compression ignition engine (i.e., diesel engine) or a spark ignition engine (i.e., gasoline engine). For many heavy work vehicles, the power system includes a diesel engine that may have higher lugging, pull-down, and torque characteristics for associated work operations. A portion of the exhaust may be redirected back into the engine in an exhaust recirculation arrangement while the remaining exhaust is directed into an exhaust treatment system and out of the vehicle.

SUMMARY OF THE DISCLOSURE

The disclosure provides an integrated exhaust system apparatus for a power system of a work vehicle.

In one aspect, the disclosure provides an integrated exhaust system apparatus configured to be mounted on an engine generating an exhaust. The apparatus includes an apparatus housing including at least one apparatus housing wall defining an apparatus interior; an engine interface positioned in the at least one apparatus housing wall with at least one exhaust apparatus inlet configured to direct the exhaust from the engine through the at least one apparatus housing wall into the apparatus interior; an exhaust system interface positioned in the at least one apparatus housing wall with at least one first exhaust apparatus outlet configured to direct a first portion of the exhaust from the apparatus interior through the at least one apparatus housing wall; an EGR (exhaust gas recirculation) interface positioned in the at least one apparatus housing wall with at least one second exhaust apparatus outlet configured to direct a second portion of the exhaust from the apparatus interior through the at least one apparatus housing wall; and an exhaust manifold arranged within the apparatus interior proximate to the at least one exhaust apparatus inlet. The exhaust manifold includes a manifold wall defining a manifold interior configured to receive the exhaust from the at least one exhaust apparatus inlet, a first manifold outlet positioned within the manifold wall and configured to direct the first portion of the exhaust out of the manifold interior, wherein the first manifold outlet is fluidly coupled to the at least one first exhaust apparatus outlet, and a second manifold outlet within the manifold wall and configured to direct the second portion of the exhaust out of the manifold interior. The apparatus further includes an EGR cooler arranged within the apparatus interior and including a plurality of EGR cooler exhaust passages with first EGR cooler exhaust passage ends fluidly coupled such that the EGR cooler exhaust passages receive the second portion of the exhaust and second EGR cooler exhaust passage ends fluidly coupled such that the second portion of the exhaust is directed out of the EGR cooler exhaust passages to be directed out of the apparatus housing via the at least one second exhaust apparatus outlet.

In another aspect, the disclosure provides an engine arrangement includes an engine configured to generate exhaust and an integrated exhaust system apparatus mounted to the engine. The apparatus includes an apparatus housing including at least one apparatus housing wall defining an apparatus interior; an engine interface positioned in the at least one apparatus housing wall with at least one exhaust apparatus inlet configured to direct the exhaust from the engine through the at least one apparatus housing wall into the apparatus interior; an exhaust system interface positioned in the at least one apparatus housing wall with at least one first exhaust apparatus outlet configured to direct a first portion of the exhaust from the apparatus interior through the at least one apparatus housing wall; an EGR (exhaust gas recirculation) interface positioned in the at least one apparatus housing wall with at least one second exhaust apparatus outlet configured to direct a second portion of the exhaust from the apparatus interior through the at least one apparatus housing wall; an exhaust manifold arranged within the apparatus interior proximate to the at least one exhaust apparatus inlet, the exhaust manifold including a manifold wall defining a manifold interior configured to receive the exhaust from the at least one exhaust apparatus inlet, a first manifold outlet positioned within the manifold wall and configured to direct the first portion of the exhaust out of the manifold interior, wherein the first manifold outlet is fluidly coupled to the at least one first exhaust apparatus outlet, and a second manifold outlet within the manifold wall and configured to direct the second portion of the exhaust out of the manifold interior; and an EGR cooler arranged within the apparatus interior and including a plurality of EGR cooler exhaust passages with first EGR cooler exhaust passage ends fluidly coupled such that the EGR cooler exhaust passages receive the second portion of the exhaust and second EGR cooler exhaust passage ends fluidly coupled such that the second portion of the exhaust is directed out of the EGR cooler exhaust passages to be directed out of the apparatus housing via the at least one second exhaust apparatus outlet. The engine arrangement further includes a first turbocharger mounted to the integrated exhaust system apparatus and fluidly coupled to the at least one first exhaust apparatus outlet to receive the first portion of the exhaust and an EGR system extending between the at least one second exhaust apparatus outlet and the engine to direct the second portion of the exhaust from the integrated exhaust system apparatus to the engine.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
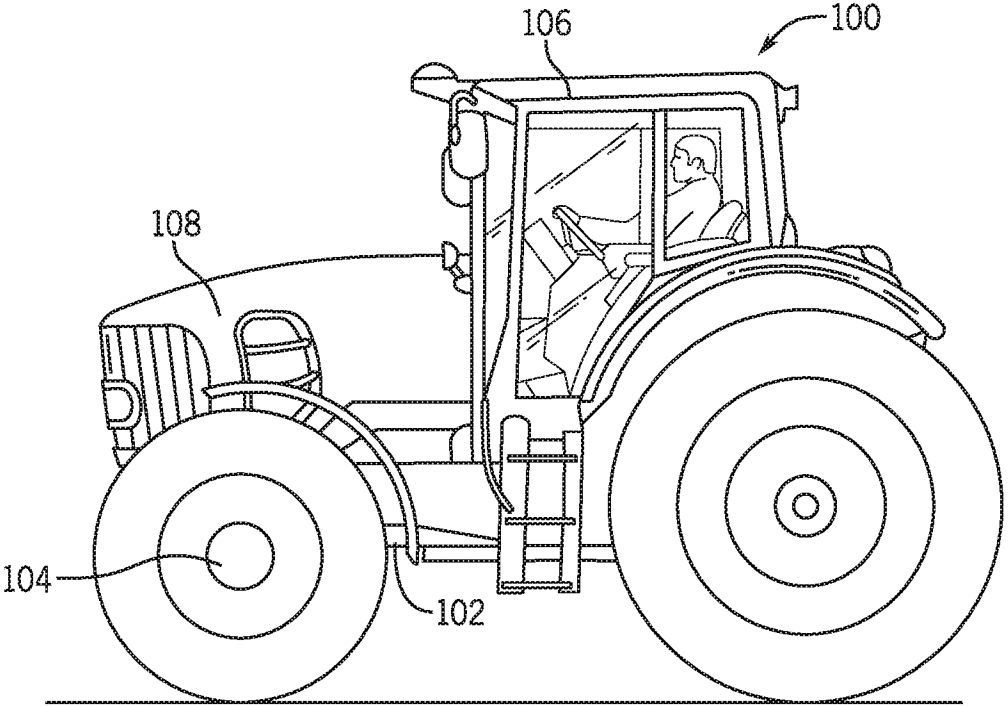
FIG. 1 is a side view of an example work vehicle in the form of a tractor in which an integrated exhaust system apparatus may be used in accordance with this disclosure.

The following describes one or more example embodiments of the disclosed integrated exhaust system apparatus and method, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Furthermore, in detailing the disclosure, terms of direction and orientation, such as "downstream," "upstream," "longitudinal," "radial," "axial," "circumferential," "lateral", and "transverse" may be used. Such terms are defined, at least in part, with respect to an integrated exhaust system apparatus, annular passages or components, and/or the direction of exhaust flow. As used herein, the term "longitudinal" indicates an orientation along the length of the apparatus; the term "lateral" indicates an orientation along a width of the apparatus and orthogonal to the longitudinal orientation; and the term "transverse" indicates an orientation along the height of the apparatus and orthogonal to the longitudinal and lateral orientations.

As noted, work vehicles may include power systems with diesel engines to produce torque in a wide range of applications, such as long-haul trucks, tractors, agricultural or construction vehicles, surface mining equipment, non-electric locomotives, stationary power generators and the like. During the combustion process, diesel engines generate exhaust. A portion of the exhaust may be redirected back into the engine in an exhaust gas recirculation (EGR) arrangement while the remaining exhaust is directed into an exhaust treatment system and out of the vehicle. In some examples, the EGR arrangement functions to reduce nitrogen oxide (NOx) emissions by lowering the oxygen concentration in the combustion chamber, as well as through heat absorption. The exhaust treatment system functions to remove particulates, nitrogen oxides (NOx), and other types of pollutants. These systems facilitate compliance with increasingly strict emissions standards and provide operational improvements.

As described herein, the power system may include an integrated exhaust system apparatus that performs multiple functions, such as an exhaust manifold to distribute exhaust from the engine between the EGR system and the exhaust treatment system and as an EGR cooler to reduce the temperature of the EGR exhaust prior to being redirected back into the engine. The integrated exhaust apparatus is packaged as an integral unit with a common cooling circuit. In one embodiment, the exhaust manifold and EGR cooler are arranged within a common housing, parallel to one another and coupled together with a conduit also within a housing, thereby enabling the exhaust entering the manifold to be distributed into multiple exhaust portions, a first exhaust portion to be directed from the manifold out of the apparatus into the turbochargers, a second portion to be directed from the manifold into the EGR cooler, the second portion to be cooled within the EGR cooler, and the cooled exhaust portion to be directed from the EGR cooler out of the apparatus into the EGR system. The cooling circuit within the housing cools multiple portions of the apparatus and exhaust therein, including as a heat shield around the manifold, at the conduit between the manifold and the cooler, and within the cooler. This enables a reduced part count and a compact, space-efficient package that provides additional room and options in the engine area. The integrated exhaust apparatus may be manufactured as a single piece, for example, using additive manufacturing. Additionally, the configuration of the integrated exhaust apparatus provides more robust operation.

The following describes one or more example implementations of the disclosed systems and methods for improving the power system, particularly aspects of dealing with the exhaust of power systems with an integrated exhaust system apparatus, as compared to conventional systems. Discussion herein may sometimes focus on the example application of power system in a tractor, but the disclosed power system is applicable to other types of work vehicles and/or other types of engine systems.

Referring to FIG. 1, in some embodiments, the disclosed integrated exhaust system apparatuses and associated power systems and methods may be used with a work vehicle 100. As shown, the work vehicle 100 may be considered to include a main frame or chassis 102, a drive assembly 104, an operator platform or cabin 106, and a power system 108. As is typical, the power system 108 includes an internal combustion engine used for propulsion of the work vehicle 100 via the drive assembly 104 based on commands from an operator in the cabin 106.

As described below, the power system 108 may further include an exhaust recirculation (EGR) system that redirects a portion of the engine exhaust back into the engine and an exhaust treatment system that functions to reduce pollutants prior to emission of the engine exhaust into the atmosphere. As described below, various components may facilitate operation of the EGR system and exhaust treatment system, including an integrated exhaust system apparatus as described in FIGS. 2-15. Although not shown or described in detail herein, the work vehicle 100 may include any number of additional or alternative systems, subsystems, and elements.

Figure 2:
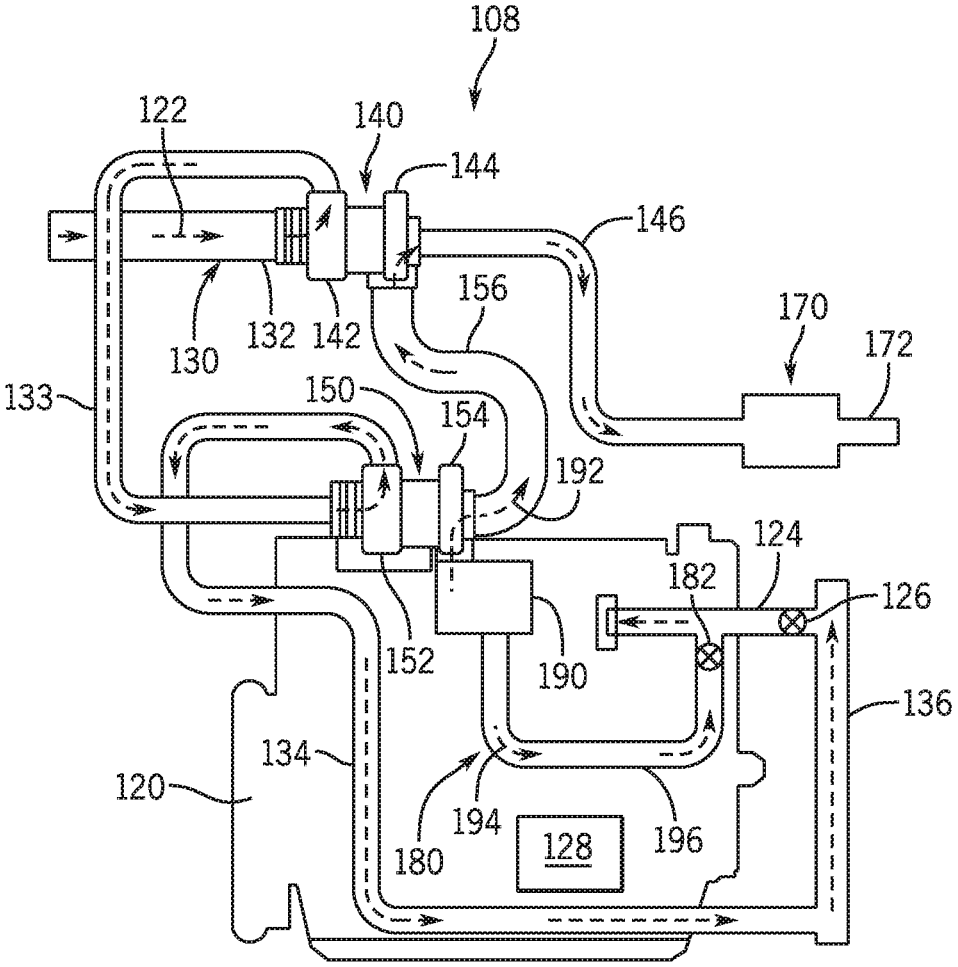
FIG. 2 is a simplified schematic diagram of a power system in accordance with an example embodiment.

Referring to FIG. 2, there is shown a schematic illustration of the power system 108 for providing power to the vehicle 100 of FIG. 1, although the characteristics described herein may be applicable to a variety of machines, such as on-highway trucks, construction vehicles, marine vessels, stationary generators, automobiles, agricultural vehicles, and recreation vehicles.

As introduced above, the power system 108 includes an engine 120 configured to generate power that drives propulsion and various other systems. Generally, engine 120 may be any kind of internal combustion engine that produces an exhaust gas, such as a gasoline engine, a diesel engine, a gaseous fuel burning engine (e.g., natural gas) or any other exhaust producing engine. As an example, the engine 120 described below is a diesel engine. The engine 120 may be of any size, with any number cylinders, and in any configuration. In addition to the features discussed below, the engine 120 may include any suitable feature, such as fuel systems, air systems, cooling systems, peripheries, drivetrain components, sensors, etc.

Generally, the power system 108 and/or engine 120 may be considered to include an intake system 130, a first turbocharger 140, a second turbocharger 150, an exhaust recirculation (EGR) system 180, and an exhaust treatment system 170. The intake system 130 includes one or more intake conduits 132, 133, 134 and various other components (such as an intake manifold, not shown) for introducing a fresh intake gas, as indicated by directional arrow 122, into the engine 120. Generally, each turbocharger 140, 150 is formed by a respective compressor 142, 152, rotationally coupled to be driven by a corresponding turbine 144, 154, described in greater detail below. During operation, the intake system 130 directs the intake air through the compressors 142, 152 via the conduits 132, 133, 134 in order to increase the amount of air subsequently forced into the engine 120, thereby improving engine efficiency and power output. Each of the compressors 142, 152 may be a fixed geometry compressor, a variable geometry compressor, supercharger, eCompressor, eTurbo, or any other type of compressor.

The intake system 130 may further include a charge air cooler 136 downstream of the compressors 142, 152 to cool the fresh intake gas. The intake gas then enters an engine intake conduit 124 that is fluidly coupled to direct the intake gas into the engine cylinders. An air throttle actuator 126 may be positioned downstream of the charge air cooler 136 within the engine intake conduit 124 to regulate the air-fuel ratio. The air throttle actuator 126 may be, for example, a flap type valve controlled by an electronic control unit ("ECU") or controller 128.

During combustion, the engine 120 produces an exhaust gas that is received by an integrated exhaust system apparatus 190. In particular, the integrated exhaust system apparatus 190 is fluid communication with engine cylinders such that, during an exhaust stroke, at least one exhaust valve (not shown) opens, allowing the exhaust gas to flow out of the cylinders into the integrated exhaust system apparatus 190.

As described in greater detail below with reference to FIGS. 3-13, the integrated exhaust system apparatus 190 performs a number of functions, including dividing the exhaust gas into a first portion and a second portion; directing the first portion of the exhaust gas toward downstream exhaust components, including an exhaust treatment system 170; cooling the second portion of the exhaust gas; and directing the cooled second portion of the exhaust gas to an exhaust recirculation system (EGR) 180. Collectively, the exhaust treatment system 170 and EGR system 180 (as well as other systems or subsystems) may be considered an exhaust system.

The first portion of exhaust gas (represented by arrow 192 in FIG. 3) from the integrated exhaust system apparatus 190 is utilized to power the second turbocharger 150 and then the first turbocharger 140. In this example, the turbochargers 140, 150 are configured as series turbochargers with the second turbocharger 150 being a high pressure turbocharger and the first turbocharger 140 being a low pressure turbocharger. In particular, the turbine 154 of the high pressure turbocharger 150 is configured to receive the second portion of exhaust gas such that the turbine 154 drives the rotationally coupled compressor 152 of the high pressure turbocharger 150. The exhaust gas then flows via a conduit 156 into the turbine 144 of the low pressure turbocharger 140 such that the turbine 144 drives the rotationally coupled compressor 142 of the low pressure turbocharger 140. From the low pressure turbocharger 140, the exhaust gas may be directed through conduit 146 into an exhaust treatment system 170, schematically shown in FIG. 2.

Generally, the exhaust treatment system 170 functions to treat the exhaust gas passing therethrough. Although not described in detail, the exhaust treatment system 170 may include various components to reduce undesirable emissions. As examples, the exhaust treatment system 170 may include an inlet tube, diesel oxidation catalyst (DOC), a diesel particulate filter (DPF), a selective catalytic reduction (SCR) system, and an outlet tube. The DOC of the exhaust treatment system 170 may be configured in a variety of ways and contain catalyst materials useful in collecting, absorbing, adsorbing, reducing, and/or converting hydrocarbons, carbon monoxide, and/or nitrogen oxides (NOx) contained in the exhaust. The DPF of the exhaust treatment system 170 may be any of various particulate filters known in the art configured to reduce particulate matter concentrations, e.g., soot and ash, in the exhaust. The SCR system of the exhaust treatment system 170 functions to reduce the amount of NOx in the exhaust flow, such as by selectively injecting a reductant into the flow of exhaust that, upon mixing with the exhaust, evaporates and decomposes or hydrolyzes to produce ammonia, which reacts with NOx for reduction into less harmful emissions. After being treated by the exhaust treatment system 170, the exhaust gas is expelled into the atmosphere via a tailpipe 172.

The second portion of exhaust gas (represented by arrow 194 in FIG. 3) from the integrated exhaust system apparatus 190 is utilized by the EGR system 180 as recirculated exhaust gas. In particular, the recirculated exhaust gas is directed out of the integrated exhaust system apparatus 190 and into conduit 196, which is fluidly coupled to the engine intake conduit 124. An EGR valve 182 may be arranged within the conduit 196 to control the flow of recirculated gas into the engine intake conduit 124 based on commands from the controller 128. The recirculated gas is mixed with the fresh intake air and enters the engine 120 for combustion.

Figure 3:
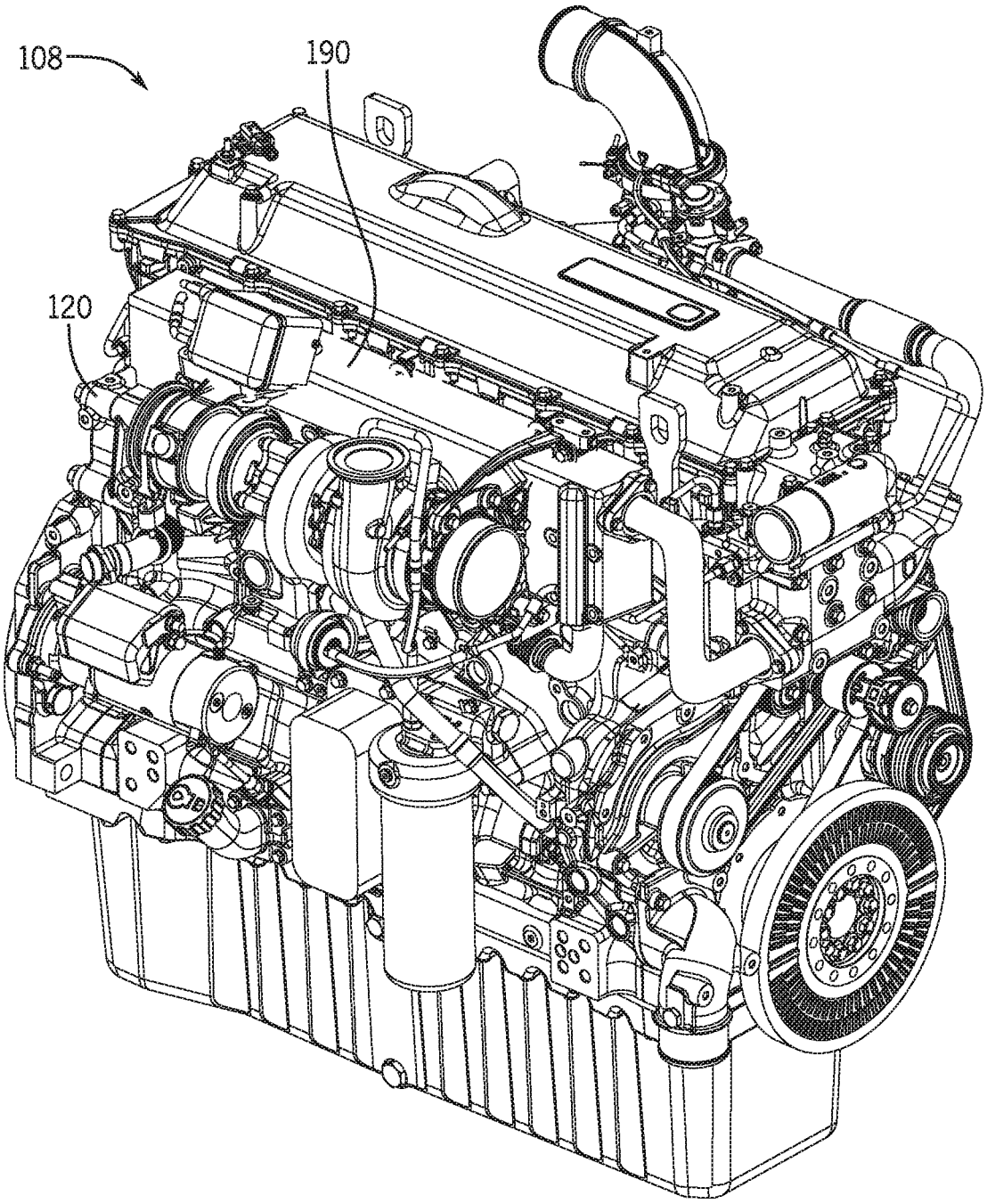
FIG. 3 is an example arrangement of the power system of FIG. 2 in accordance with an example embodiment.

In conjunction with FIG. 2, FIG. 3 depicts one example of an isometric view of an arrangement of the power system 108 described above. In particular, the integrated exhaust system apparatus 190 is mounted on the engine 120 to receive the exhaust gas, as discussed above. As also discussed above, the high pressure turbocharger 150 fluidly coupled to receive the first portion of the exhaust gas from the integrated exhaust system apparatus 190. In this example, the turbine 154 of the high pressure turbocharger 150 is mounted to the integrated exhaust system apparatus 190. Although not clearly depicted in FIG. 3, the integrated exhaust system apparatus 190 may also support portions of the low pressure turbocharger 140, as well as other components of the engine 120 and/or power system 108. The view of FIG. 3 additionally depicts the conduit 196 that fluidly couples the integrated exhaust system apparatus 190 to the EGR system 180. Additional details of the integrated exhaust system apparatus 190 will be provided below with reference to FIGS. 4-13.

Figure 4:
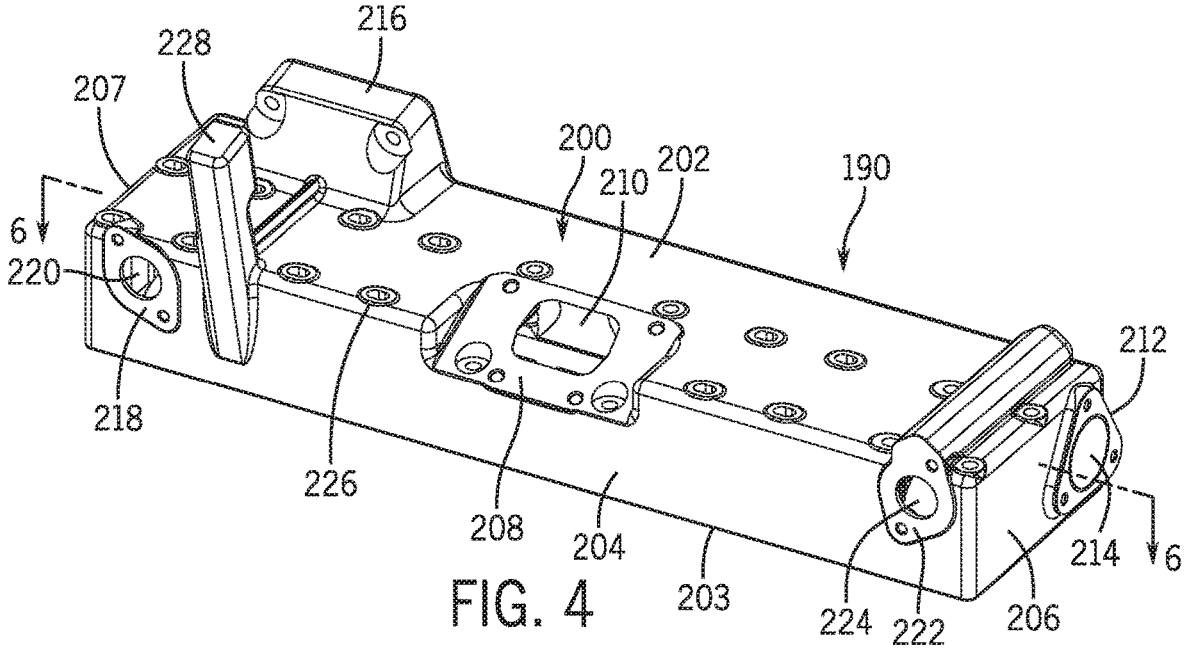
FIG. 4 is a first isometric view of an integrated exhaust system apparatus of the power system of FIG. 3 in accordance with an example embodiment.
Figure 5:
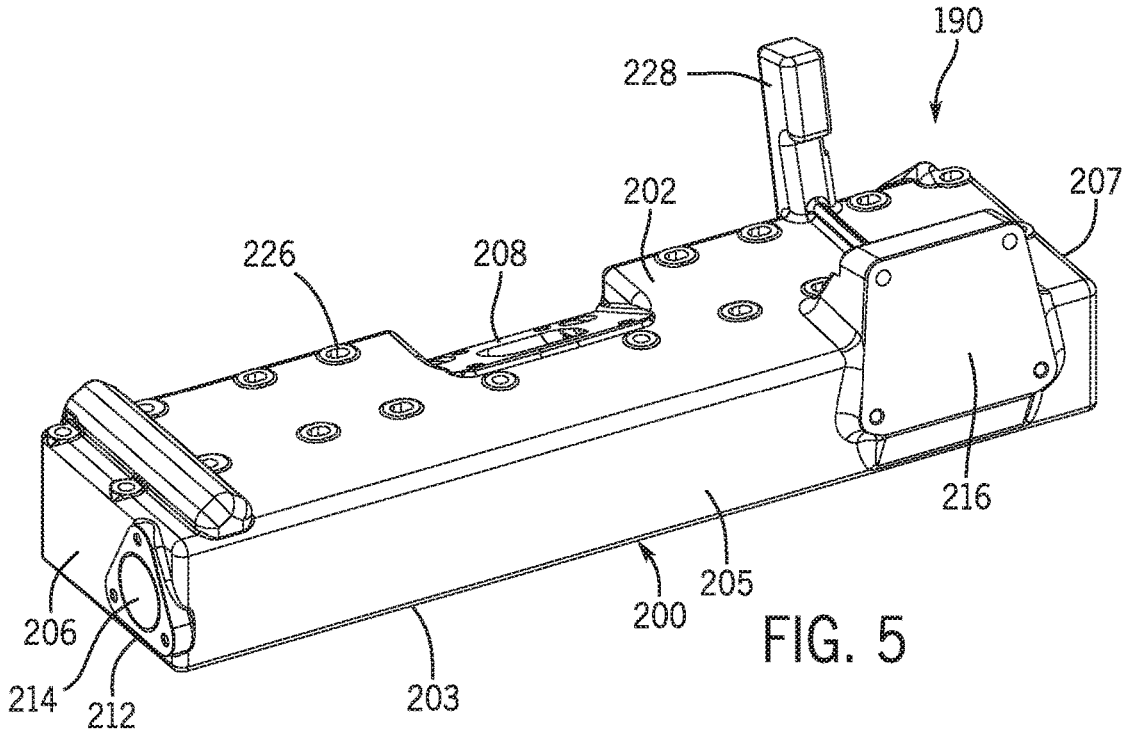
FIG. 5 is a second isometric view of the integrated exhaust system apparatus of FIG. 4 in accordance with an example embodiment.

FIGS. 4 and 5 depict first and second isometric views of the integrated exhaust system apparatus 190. The views of FIGS. 4 and 5 may be considered an outer or external view and particularly depicts an apparatus housing 200 that contains and/or supports a number of apparatus components.

The apparatus housing 200, in one example, is generally box shaped and formed by a number of housing walls 202-207. Relative to one example orientation, the housing walls 202-207 includes an upper housing wall 202 (facing away from the engine 120 when mounted), a lower housing wall 203 (facing the engine 120 when mounted), two side housing walls 204, 205, and two end housing walls 206, 207. Each of the housing walls 202-207 may be considered to have inner surfaces that collectively define an interior of the apparatus housing 200 and outer surfaces, opposite the inner surfaces, that face adjacent engine or vehicle components. It should be noted that the terms "upper, bottom, side, and end" are relative terms and/or refer to one example orientation.

The apparatus housing 200 and walls 202-207 further support and/or define a number of interfaces, inlets, and outlets that enable cooperation of the apparatus 190 with other components of the engine 120 and/or power system 108. Although many of these features are discussed in greater detail below, a brief introduction of the features on the apparatus housing 200 will now be described.

In this example, the apparatus housing 200 includes an exhaust system interface 208 that interfaces with downstream components of the exhaust system, particularly the turbochargers 140, 150 discussed above. In particular, the exhaust system interface 208 may be considered to be on the upper housing wall 202, the side housing wall 204, or on a slanted portion spanning the upper and side housing walls 202, 204, although any suitable location may be provided. The exhaust system interface 208 defines a first exhaust apparatus outlet 210 that fluidly couples the apparatus 190 to the high pressure turbocharger 150 such that a portion of the exhaust from the apparatus 190 is directed into the turbine 154 of the high pressure turbocharger 150, as discussed above. As shown, the exhaust system interface 208 defines a surface that receives one or more fasteners to enable the high pressure turbocharger 150 to be directly mounted to the integrated exhaust system apparatus 190 to receive the first portion of exhaust flow via the first exhaust apparatus outlet 210.

The apparatus housing 200 further includes an EGR interface 212 that interfaces with downstream components of the EGR system 180 discussed above. The EGR interface 212 may be considered to be on the first end housing wall 206, although any suitable location may be provided. The EGR interface 212 defines a second exhaust apparatus outlet 214 as an opening or orifice that fluidly couples the apparatus 190 to a conduit of the EGR system 180, such as conduit 196 (FIG. 2), to enable the recirculated exhaust gas to be directed back into the engine 120. In one example, the EGR interface 212 provides a mounting or coupling location for the EGR conduit 196.

Additionally, the apparatus housing 200 includes a low pressure turbocharger interface flange 216 that, in this example, extends from the side wall housing 205 beyond the upper housing wall 202. The low pressure turbocharger interface flange 216 provides a mounting location and support for the low pressure turbocharger 140 (FIG. 2). As introduced above with reference to FIG. 2, the low pressure turbocharger 140 is mounted on interface flange 216 of the apparatus 190 in a position for the low pressure turbocharger 140 to be fluidly coupled to receive exhaust flow from the high pressure turbocharger 150 to drive the turbine 144 of the low pressure turbocharger 140, and to subsequently direct the exhaust to downstream exhaust components.

The apparatus housing 200 further includes a coolant inlet interface 218 that defines a coolant inlet 220 such that an external coolant conduit (not shown) may deliver coolant to a cooling circuit within the interior of the apparatus 190. Similarly, apparatus housing 200 includes a coolant outlet interface 222 that defines a coolant outlet 224 such that coolant within the cooling circuit of the apparatus 190 may be directed out of the apparatus 190 to a further external cooling system (not shown). The coolant inlet interface 218 is positioned on the first side housing wall 204 proximate to the end housing wall 207, and the coolant outlet interface 222 is positioned on the other end housing wall 206 proximate to the other end housing wall 206. The cooling circuit 280 may be part of a larger cooling system for other portions of the engine or vehicle, and in other examples, the cooling circuit 280 may be dedicated to the to the apparatus 190.

The apparatus housing 200 may further support one of more mounting structures 226 in the form of through-holes or bosses that extend between the upper housing wall 202 and the lower housing wall 203. The mounting structures 226 are configured to receive fasteners (e.g., bolts) that extend through the mounting structures 226 and into corresponding mounting structures on the cylinder head of the engine (or other mounting location), thereby enabling the apparatus 190 to be mounted to the engine 120. In particular, the mounting structures 226 enable the apparatus 190 to be mounted to receive the exhaust from the cylinders of the engine 120 (FIG. 3). In one example, approximately four mounting structures 226 are provided for each cylinder (e.g., approximately four mounting structures surrounding each cylinder opening), while in other examples, one, two, or any number of mounting structures 226 are provided for coupling the apparatus 190 to the engine 120.

The apparatus housing 200 may additionally include any number of mounting or support structures and/or interfaces, such as support structure 228. For example, the apparatus housing 200 may include a flange or structure 228 to support an exhaust valve.

Figure 6:
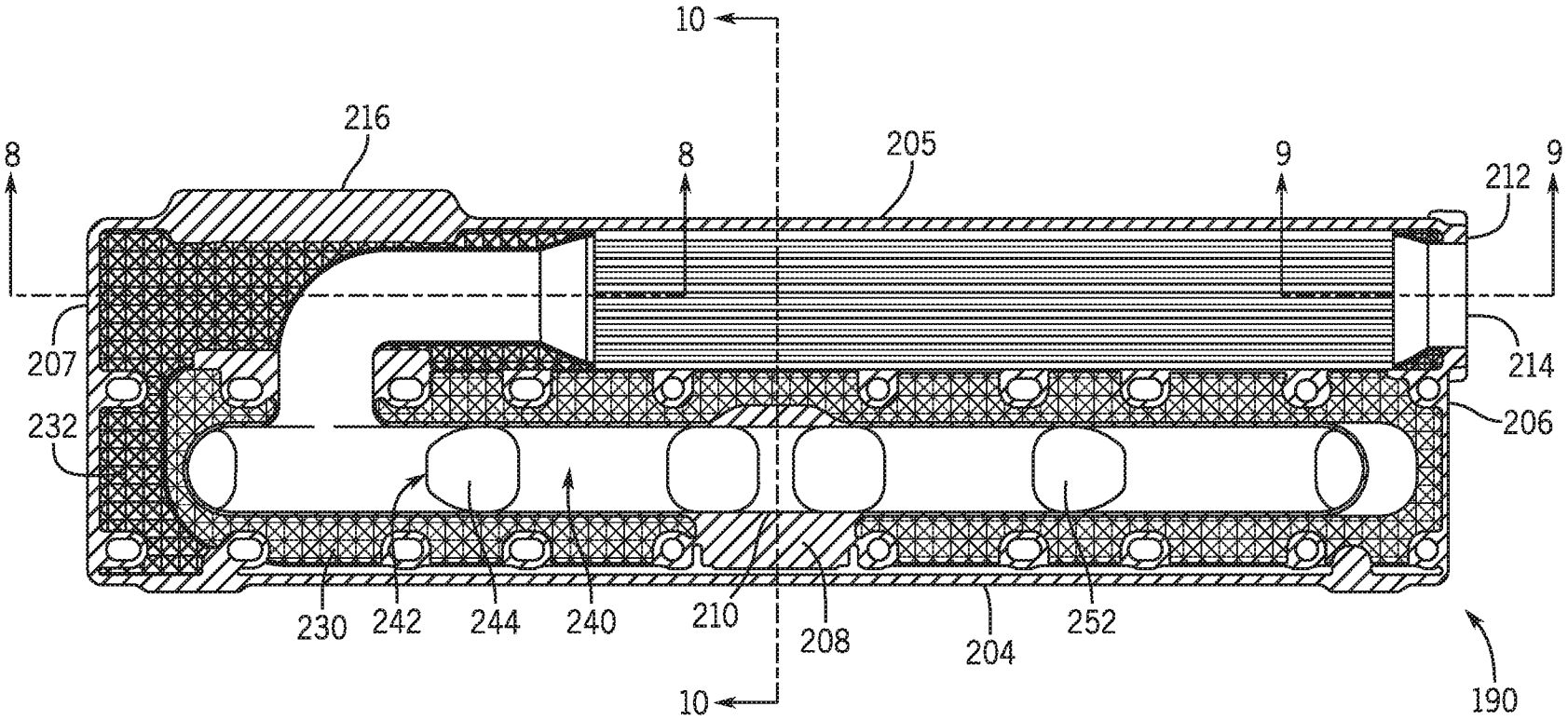
FIG. 6 is a cross-sectional view of the integrated exhaust system apparatus through line 6-6 of FIG. 4 in accordance with an example embodiment.

Reference is now made to FIG. 6, which is a cross-sectional view of the integrated exhaust system apparatus 190 through line 6-6 of FIG. 4. As noted above, the exhaust system apparatus 190 includes a housing 200, including the housing walls 202-207 depicted in FIG. 5.

Generally, the interior of the integrated exhaust system apparatus 190 is supported by one or more types of lattice structures 230, 232. The lattice structures 230, 232 may be configured as predetermined geometric structures to support structural stability, desired function, and/or facilitation of manufacturing. The lattice structures 230, 232 may vary with respect to density, size, and shape to provide a suitable flow path in certain areas, e.g., to provide a uniform cooling flow and/or to direct additional or less cooling flow to particular locations, as described below. In the depicted embodiment of FIG. 6, at least two different types of lattice structures 230, 232 are provided, although in other embodiments, more than two or a single type of lattice structure may be used. Additional details regarding the lattice structures 230, 232 are provided below.

Figure 7:
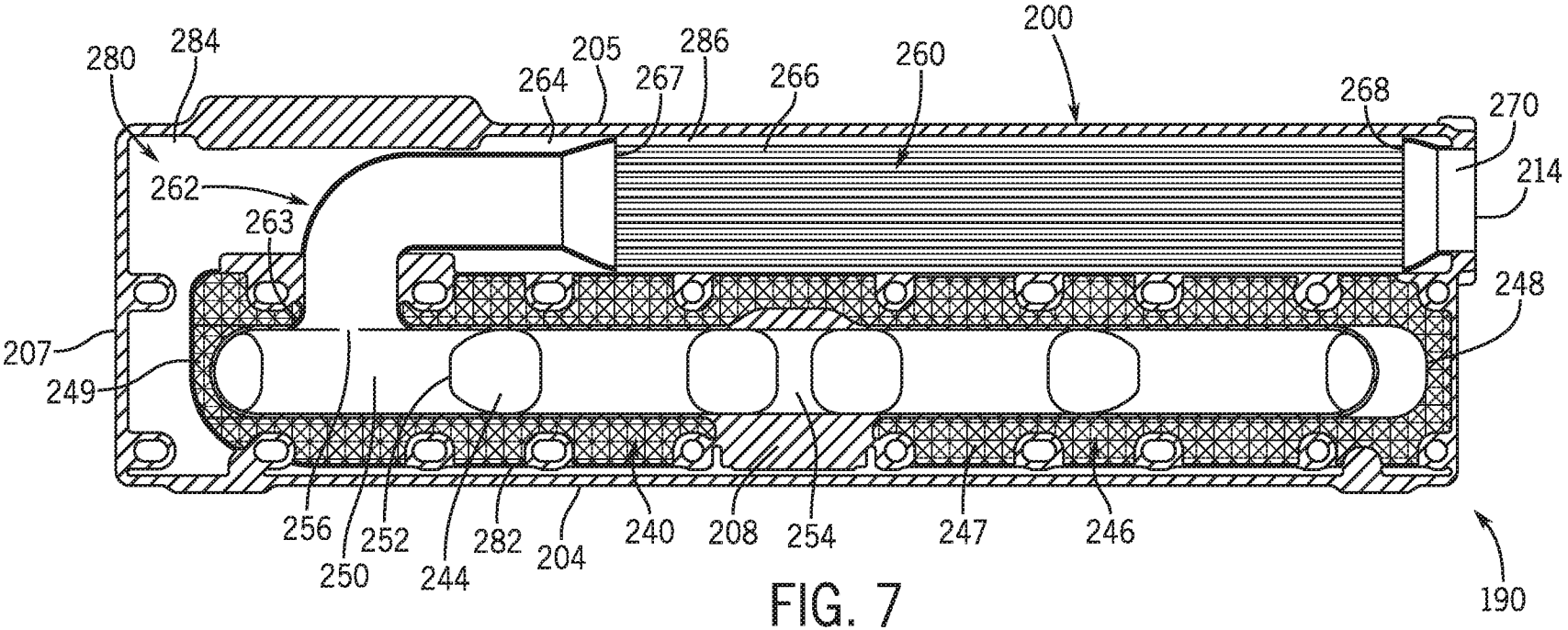
FIG. 7 is a further cross-sectional view of the integrated exhaust system apparatus of FIG. 4 in accordance with an example embodiment.

Reference is additionally made to FIG. 7, which is a cross-sectional view similar to that of FIG. 6 with a portion of the lattice structure 232 removed for clarity. Generally, the interior of the exhaust system apparatus 190 supports an exhaust manifold 240, an EGR cooler 260, and a cooling circuit 280 within the housing 200.

The exhaust manifold 240 is generally configured to receive and distribute the exhaust received by the apparatus 190 via one or more exhaust apparatus inlets 244. The exhaust manifold 240 includes, or is otherwise proximate to, an engine interface 242 on the lower housing wall 203 that enables the apparatus 190 to interface with the engine 120, particularly the cylinders of the engine 120. Specifically, the engine interface 242 defines the exhaust apparatus inlets 244 that are positioned to receive exhaust from the engine 120.

The exhaust manifold 240 is formed by at least one manifold wall 246, including a side wall portion 247 and first and second end wall portions 248, 249. The manifold walls 246 may be generally cylindrical to define a manifold interior 250 extending at a length of the side wall portion 247 along a manifold longitudinal axis between the two end wall portions 248, 249. In this example, the first end wall portion 248 is proximate to the end wall 206 of the apparatus 190, and the second end wall portion 249 is proximate to the second end housing wall 207 of the apparatus 190. Generally, the manifold walls 246 may have any suitable shape within the apparatus housing 200.

The exhaust inlet ports 252 may be formed in one or more of the manifold walls 246 in fluid communication with the exhaust apparatus inlets 244 of the apparatus housing 200. The exhaust manifold 240 may receive the exhaust flowing through the exhaust apparatus inlets 244 via corresponding exhaust inlet ports 252, discussed below. In one embodiment, exhaust inlet ports 252 may be considered to be co-located with the exhaust apparatus inlets 244 (e.g., the exhaust apparatus inlets 244 form the exhaust inlet portions 252, and/or portions of the manifold walls 246 form portions of the apparatus housing 200 and/or the engine interface 242). In other examples, the exhaust apparatus inlets 244 may be separate from the inlet ports 252 and fluidly coupled together with one or more conduits (e.g., such the apparatus housing 200 is separated from or abuts with manifold walls 246).

In this example, the exhaust manifold 240 includes six inlet ports 252 (and six exhaust inlets 244). In particular, the number of inlet ports 252 matches the number of cylinders of the engine 120 (e.g., one port 252 for each cylinder), although other configurations may be provided, such as a common inlet port. As shown, the inlet ports 252 extend along the length of the exhaust manifold 240 such that exhaust enters the manifold interior 250 along the length of the manifold 240. Within the interior 250, the exhaust flows into one of two manifold exhaust outlets 254, 256.

A first manifold outlet 254 is formed within the side wall portion 247 of the manifold walls 246, approximately at the midpoint along the length. The first manifold exhaust outlet 254 is fluidly coupled (or otherwise forms) the first exhaust apparatus outlet 210, discussed above and schematically depicted in FIGS. 6 and 7. As such, a first portion of the exhaust from the manifold interior 250 flows out of the manifold 240 through the first manifold exhaust outlet 254, and out of the apparatus 190 through the first exhaust apparatus outlet 210 into the high pressure turbocharger 150 mounted to the apparatus 190 at the exhaust system interface 208.

A second manifold outlet 256 is formed within the side wall portion 247 of the manifold walls 246, on an opposite side of the manifold interior 250 as the first manifold outlet 254, proximate to the second end wall portion 249. In this example, the second manifold outlet 256 is positioned along the length of the manifold 250 in between the outermost and adjacent inlet ports 252. In other examples, the second manifold outlet 256 is positioned in the second end wall portion 249, on the side wall portion 247 beyond the outermost inlet port 252, or in another location. In this embodiment, the end wall portions 248, 249 of the manifold 240 are closed such that the exhaust entering the manifold 250 flows through the first manifold outlet 254 as a first portion of exhaust (or as exhausted exhaust) or flows through the second manifold outlet 256 as a second portion of exhaust (or as uncooled recirculation exhaust).

In one example, approximately 70% of the exhaust is directed through the first manifold outlet 254 as the first portion of exhaust and approximately 30% of the exhaust is directed through the second manifold outlet 256 as the second portion of exhaust, although other split percentages may be provided. The manifold 240 (and overall power system 108) may have a size, shape, and/or configuration to result in the desired split between exhaust portions.

As introduced above, the manifold walls 246 may be formed with an internal lattice structure 230. The lattice structure 230 may provide a number of functions. In particular, the internal lattice structure 230 is formed with a number of air pockets within the manifold wall 246 to provide a partial air gap between the exhaust within the interior of the manifold 240 and the apparatus portions surrounding the manifold 240. This arrangement inhibits heat transfer from the exhaust within the manifold 240 to other apparatus portions. For example, as described below, portions of the cooling circuit 280 surround the manifold wall 246. The configuration of the lattice structure 230 may inhibit and/or eliminate heat transfer between the exhaust in the interior 250 of the manifold 240 and the coolant within the cooling circuit 280, thereby facilitating higher priority uses of the coolant. Moreover, as described in greater detail below, the lattice structure 230 (and lattice structure 232) facilitates manufacturing of the apparatus 190 and provides internal support.

An EGR hot side conduit 262 extends between a first end 263 and a second end 264 to fluidly couple the manifold 240 at the second manifold outlet 256 to the EGR cooler 260 within the apparatus housing 200, thereby enabling the second portion of the exhaust to flow to the EGR cooler 260. In particular, the first end 263 is mounted to the manifold 240 at the second manifold exhaust outlet 256 and the second end 264 is mounted to the EGR cooler 260. In this example, the EGR hot side conduit 262 is "L-shaped" or curved from a lateral orientation at the first end 263 to a longitudinal orientation at the second end 264. In other examples, the EGR hot side conduit 262 may have different shapes or configurations, including a U-shape or a straight arrangement. This enables the second portion of exhaust from the side wall portion 247 of the exhaust manifold 240 to be redirected into the longitudinal orientation for entry into the EGR cooler 260.

At least one or both of the first and second ends 263, 264 of the EGR hot side conduit 262 may be formed by a bellows structure that enables relative axial and radial movement of the EGR hot side conduit 262, the manifold 240, and/or the EGR cooler 260. For example, in the depicted embodiment, the second end 264 of the EGR hot side conduit 262 is formed by such a bellows structure.

The EGR cooler 260 is generally elongated with a longitudinal orientation arranged parallel to the exhaust manifold 240 within the apparatus housing 200. In the lateral orientation, the EGR cooler 260 may be arranged between the housing side wall 205 and the manifold wall 246. The EGR cooler 260 is formed by a number of generally parallel cooler exhaust passages 266 that respectively extend between a first passage end 267 and a second passage end 268. The first passage ends 267 are mounted to the second end 264 of the EGR hot side conduit 262, discussed above, and the second passage ends 268 are mounted to the EGR cool side conduit 270, discussed below. Any number of passages 266 may be provided. As such, the first passage ends 267 collectively form the inlet for the EGR cooler 260 and the second passage ends 268 collectively form the outlet for the EGR cooler 260. Although arranged in parallel to one another in the depicted embodiment, the EGR cooler 260 and the exhaust manifold 240 may have other configurations, including configurations in which all or portions of the cooler exhaust passages 266 are coaxial, in-line, perpendicular, and/or swept across bends relative to the exhaust manifold 240.

From the EGR hot side conduit 262, the second portion of the exhaust flows into a respective first passage end 267, through the passage 266, and out of the corresponding second passage end 268 into the EGR cool side conduit 270. Generally, the EGR cooler exhaust passages 266 are configured to transfer heat between the exhaust within the passages 266 to the coolant within the cooling circuit 280. Additional details regarding the cooling circuit 280, particularly the heat transfer between the passages 266 and coolant in the cooling circuit 280, are provided in greater detail below.

As introduced above, the apparatus cooling circuit 280 is incorporated into the apparatus 190 to remove heat from various portions. As also introduced above, coolant enters the apparatus 190 (and the apparatus cooling circuit 280) via the coolant inlet 220 and coolant exits the apparatus 190 (and the apparatus cooling circuit 280) via the coolant outlet 224. The cooling circuit 280 further includes a number of coolant cavities 282, 284, 286 that are fluidly coupled to the coolant inlet 220 and the coolant outlet 224. As such, coolant within the cooling circuit 280 flows from the coolant inlet 220, through one or more of the coolant cavities 282, 284, 286, and out of the coolant outlet 224. In one example, the coolant may be a mixture of ethylene glycol and water, although other fluids may be used, including water. Each of the cavities 282, 284, 286 will be discussed in greater detail below.

In one embodiment, a first coolant cavity 282 is directly coupled to the coolant inlet 220. The first coolant cavity 282 is arranged between the manifold walls 246 and apparatus housing 200, particularly between the manifold wall portions 247, 249 and the side housing wall 204 of the apparatus housing 200. Although, as noted above, the manifold walls 246 are structured to inhibit heat transfer between the exhaust in the manifold 240 and the coolant (e.g., coolant within the first coolant cavity 282 adjacent the manifold 240), the coolant within the first coolant cavity 282 may form a "coolant shield" or "coolant jacket" for the apparatus 190. In particular, the coolant within the first coolant cavity 282 operates to prevent elevated temperatures on the exterior surface of the housing 200 by absorbing at least a portion of heat that is transferred through the manifold walls 246 (e.g., to mitigate heat transfer from the exhaust, through the manifold walls 246, and through the housing wall 204, thereby protecting engine components proximate to the apparatus 190).

In the depicted embodiment, a second coolant cavity 284 is fluidly coupled to the first coolant cavity 282. The second coolant cavity 284 is generally arranged to surround the EGR hot side conduit 262. In particular, the second coolant cavity 284 may be considered to be bounded by portions of the end housing wall 207, the upper housing wall 202, and manifold walls 246. The second coolant cavity 284 is configured such that the heat is transferred from the second portion of the exhaust within the EGR hot side conduit 262 to the coolant, thereby at least partially reducing the temperature of the exhaust within the EGR hot side conduit 262.

In the depicted embodiment, a third coolant cavity 286 is fluidly coupled to the second coolant cavity 284. The third coolant cavity 286 forms part of the EGR cooler 260. In particular, the third coolant cavity 286 is formed between portions of the manifold walls 246 and the apparatus housing 200. In other words, the exhaust passages 266 extend through the third coolant cavity 286 such that heat may be transferred from the exhaust within the exhaust passages 266 to the coolant within the third coolant cavity 286. The coolant within the third coolant cavity 286 flows in parallel to the exhaust through the EGR cooler 260. In other embodiments, the passages 266 and third coolant cavity 286 may be arranged such that the coolant and exhaust flow in opposite (e.g., counter-flow) and/or non-parallel directions to one another. As noted above, the third coolant cavity 286 may be fluidly coupled to the coolant outlet 224 to direct the coolant from the third coolant cavity 286 out of the apparatus 190 via the coolant outlet 224.

Accordingly, during operation, exhaust from the engine 120 is forced out of the cylinders and into the exhaust system apparatus 190. As noted above, the exhaust system apparatus 190 may have an inlet port 252 for each of the cylinders such that the exhaust manifold 240 receives the exhaust. A first portion of the exhaust in the manifold 240 flows out of the first manifold outlet 254 and into the high pressure turbocharger 150 mounted on the apparatus 190. As noted above, the first portion of the exhaust operates to power the turbine 154 of the high pressure turbocharger 150, as well as the turbine 144 of the low pressure turbocharger 140, prior to being treated by the exhaust treatment system 170 and flowing out of the power system 108. The second portion of the exhaust in the manifold 240 flows out of the second manifold outlet 256 as EGR exhaust, and subsequently flows through the EGR hot side conduit 262 and into the EGR cooler 260. From the EGR cooler 260, the second portion of the exhaust flows through the EGR cool side conduit 270 and out of the apparatus 190 via the second exhaust outlet 214 as cooled recirculation exhaust to be recirculated back into the engine 120.

Figure 8:
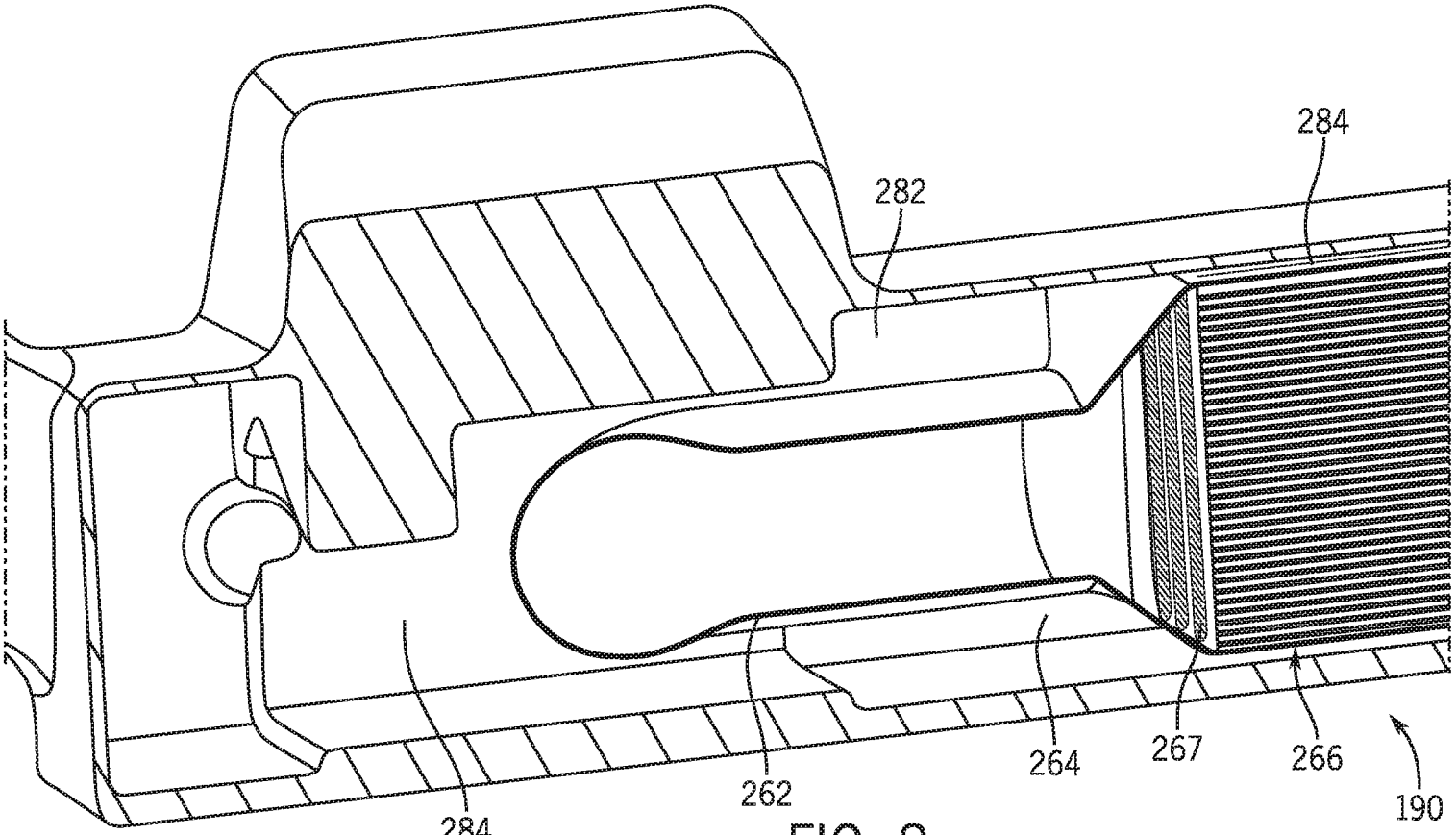
FIG. 8 is an enlarged detail sectional view of aspects of the integrated exhaust system apparatus at area 8-8 of FIG. 6 in accordance with an example embodiment.

The views of FIGS. 8-13 depict various details of the integrated exhaust system apparatus 190 described above with reference to FIGS. 4-7. In particular, FIG. 8 is a partial sectional view through area 8-8 of FIG. 6 that depicts the second coolant cavity 284, as well as portions of the EGR hot side conduit 262 and the EGR cooler 260. The view of FIG. 8 further depicts the bellows structure at the second end 264 of the EGR hot side conduit 262 and the mechanism by which the second end 264 is secured to the passages 266 of the EGR cooler 260.

Figure 9:
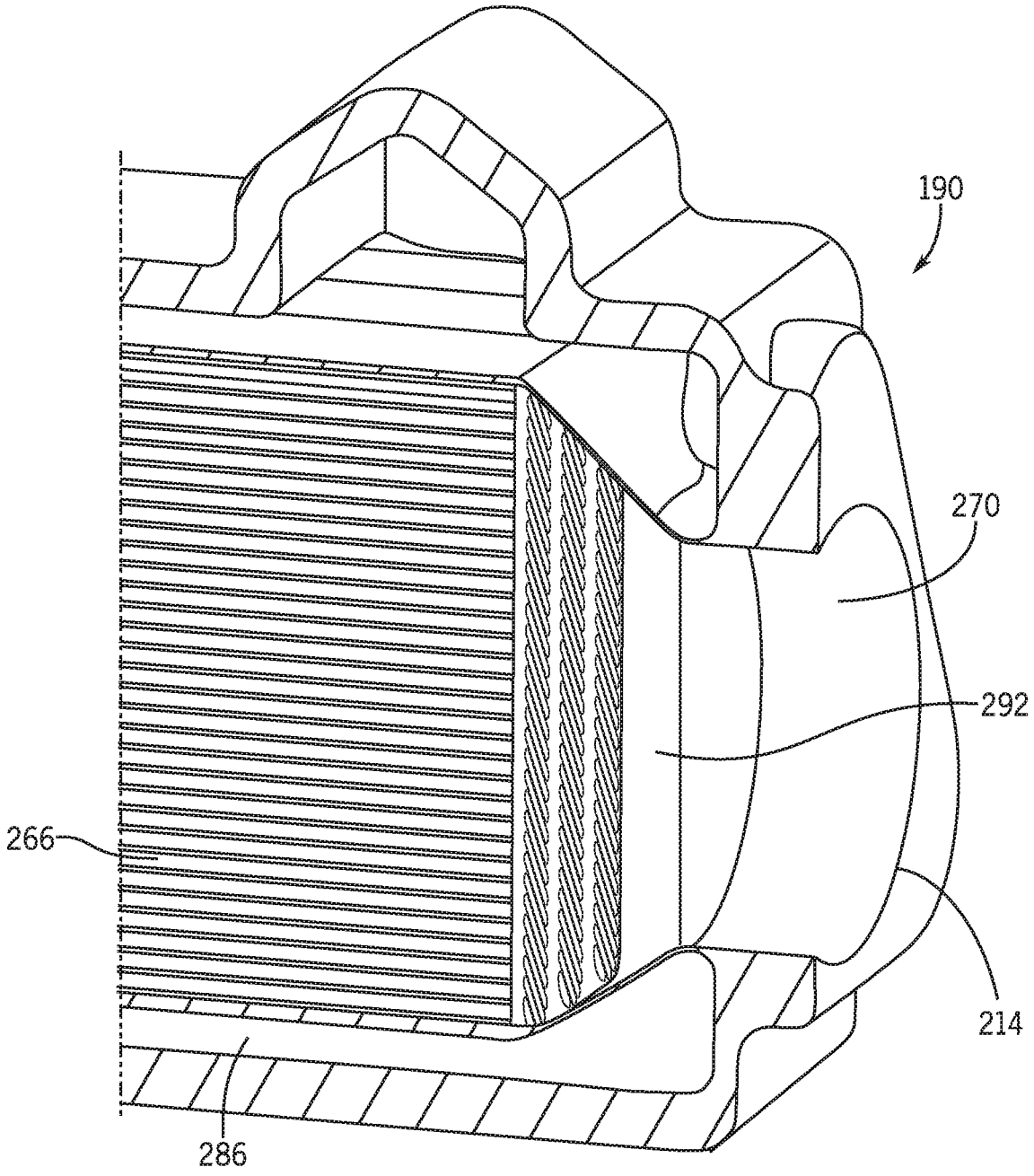
FIG. 9 is an enlarged detail sectional view of aspects of the integrated exhaust system apparatus at area 9-9 of FIG. 6 in accordance with an example embodiment.

FIG. 9 is a partial sectional view through area 9-9 of FIG. 6 that depicts the second passage ends 268 of the passages 266 of the EGR cooler 260, the EGR cool side conduit 270, and the exhaust apparatus outlet 214. A seal wall 292 may be provided to separate the third coolant cavity 286 within the EGR cooler 260 from the EGR cool side conduit 270 and the exhaust apparatus outlet 214. Although not specifically depicted in the view of FIG. 9, the third coolant cavity 286 is fluidly coupled to coolant outlet 224 (FIG. 4) seal wall 292 and the exhaust apparatus outlet 214.

As shown in FIGS. 8 and 9, the passages 266 are flush with one another at the EGR hot side conduit 262 and at the EGR cool side conduit 270. The interfaces between the cooler exhaust passages 266 and the EGR hot side conduit 262 and between the between the cooler exhaust passages 266 and the EGR cool side conduit 270 may be planar interfaces, thereby providing a more secure coupling that avoids cracking from differences in temperature.

Figure 10:
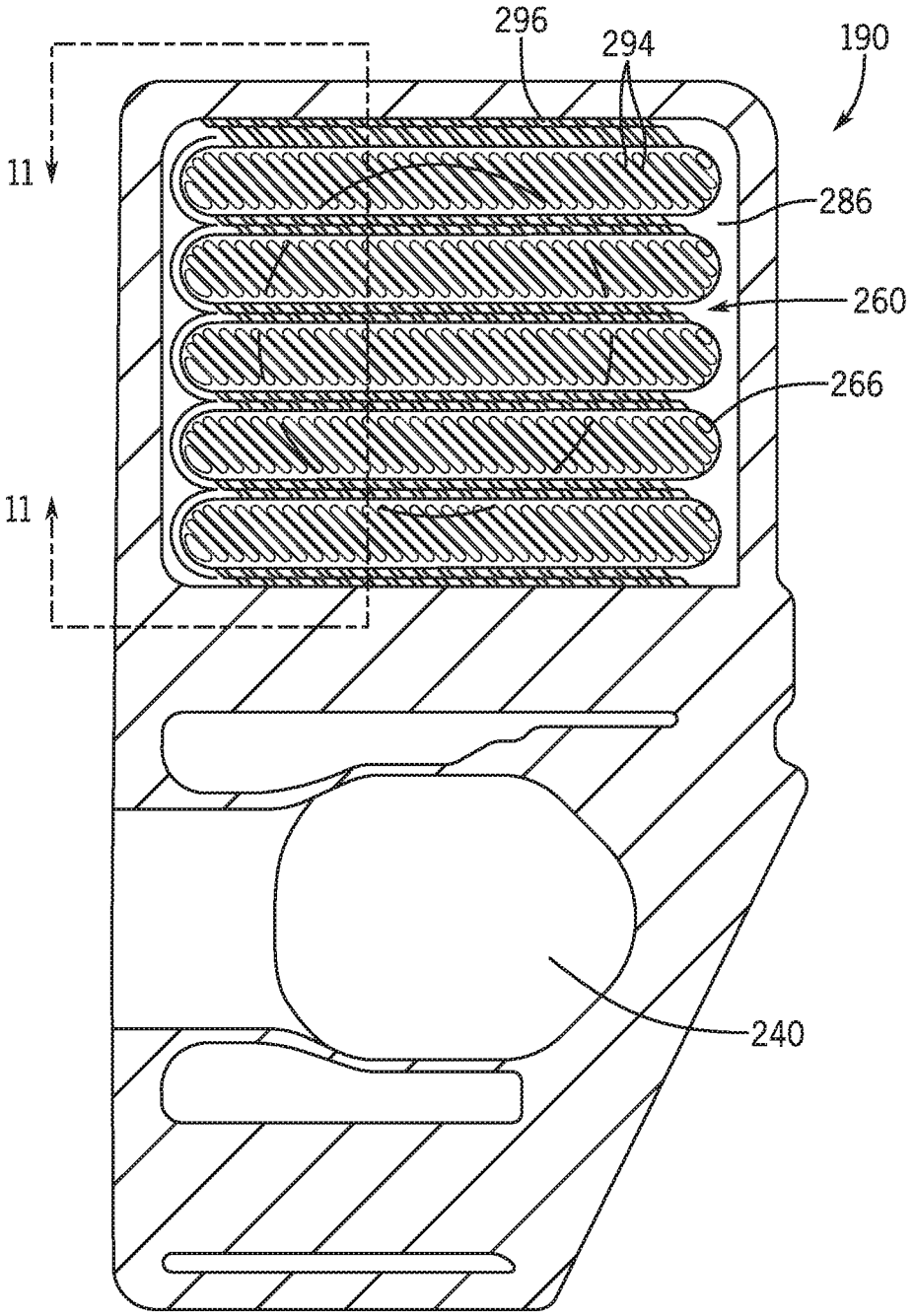
FIG. 10 is a further partial cross-sectional view of aspects of the integrated exhaust system apparatus line 10-10 of FIG. 6 in accordance with an example embodiment.
Figure 11:
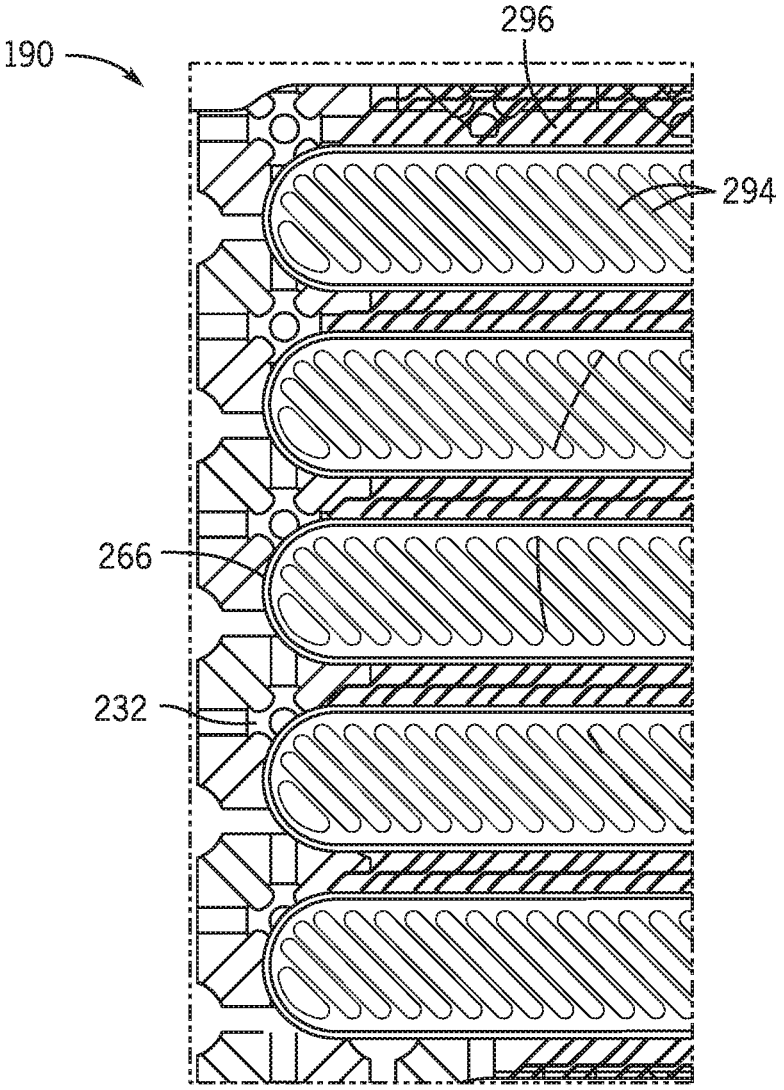
FIG. 11 is an enlarged detail view of aspects of the integrated exhaust system apparatus through at area 11-11 of FIG. 10 in accordance with an example embodiment.
Figure 12:
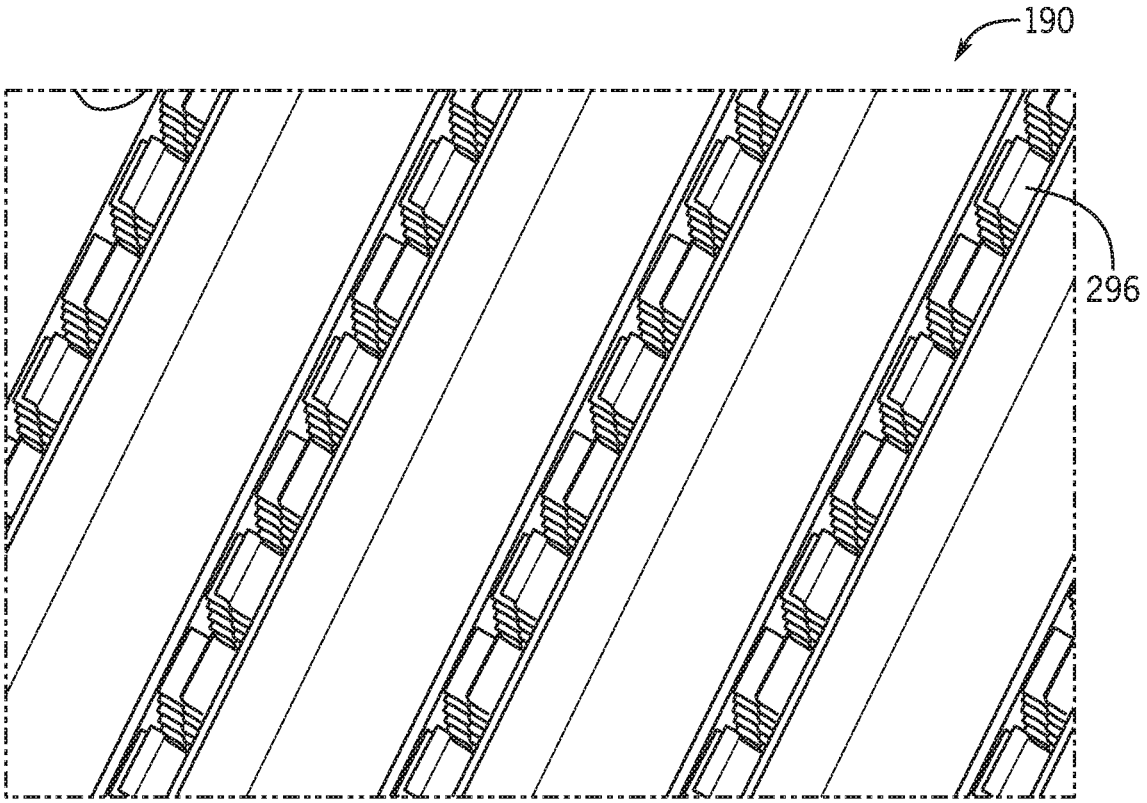
FIGS. 12 and 13 are views of cooling fins of the integrated exhaust system apparatus of FIG. 4 in accordance with an example embodiment.
Figure 13:
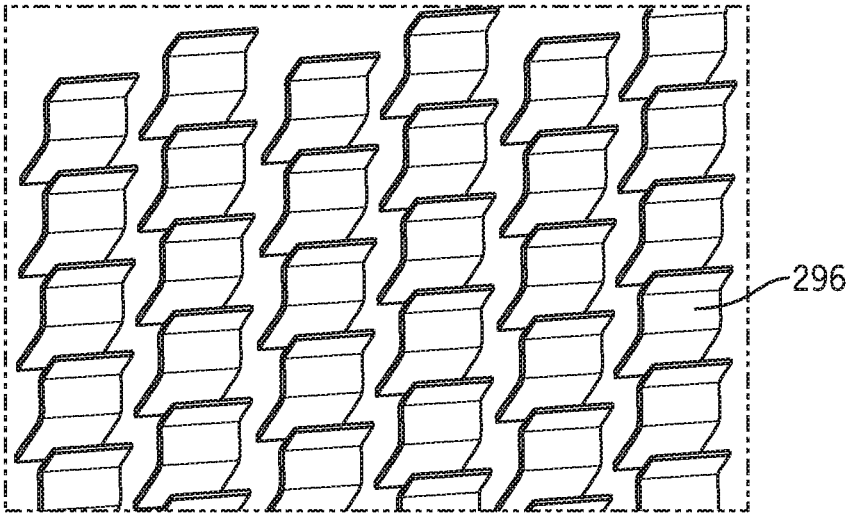

FIG. 10 is a cross-sectional view through a lateral-transverse plane, represented by line 10-10 in FIG. 6, and depicts portions of the manifold 240 and the EGR cooler 260. As shown, the EGR cooler 260 includes the passages 266 surrounded by the third coolant cavity 286. As also depicted in FIG. 10, the passages 266 of the EGR cooler 260 are provided with a number of internal cooling fins 294 and external cooling fins 296. Additional views of the cooling fins 294, 296 are provided by FIG. 11, which represent the view of area 11-11 in FIG. 10, and additional views of the external cooling fins 296 are provided by FIGS. 12 and 13. In FIG. 12, the internal cooling fins 294 have been removed for clarity.

The internal cooling fins 294 are positioned within the interior of the EGR cooler exhaust passages 266. In the depicted example, the internal cooling fins 294 extend diagonally in a lateral direction (e.g., extending at an angle between the two side walls of a respective passage 266). The internal cooling fins 294 may function to provide turbulence to the exhaust flowing through the passages such that an entire cross-section of air flow may have contact with the walls of the passages 266 to improve heat transfer. The internal cooling fins 294 may also provide additional surface area for further heat transfer paths between the exhaust within the passages 266 and the coolant, e.g., from the exhaust, through the internal cooling fins 294, through the walls of the passages 266, and to the coolant. Although the internal cooling fins 294 in the depicted embodiments are straight, other shapes, configurations, and densities may be provided. For example, the internal cooling fins 294 may be wavy.

The views of FIGS. 10-13 also depict the external cooling fins 296 that extend from the walls of the passages 266 into the third coolant cavity 286. In the depicted example, the external cooling fins 296 have a wave structure with a "Z" or "S" shape, as particularly depicted in FIG. 13. The external cooling fins 296 may agitate the coolant to facilitate heat transfer between the walls of the passages 266 and the coolant within the third coolant cavity 286. The external cooling fins 296 may also provide additional surface area for further heat transfer paths between the walls of the passages 266 and the coolant. The external cooling fins 296 may be arranged in a staggered configuration so as not to overtly constrain longitudinal coolant flow and for degassing of the third coolant cavity 286. Although the external cooling fins 296 in the depicted embodiments are wavy, other shapes, configurations, and densities may be provided. For example, the external cooling fins 296 may be straight.

The lattice structures 230, 232 were discussed above with reference to FIG. 6. The view of FIG. 13 additionally depicts the lattice structure 232 that supports the third coolant cavity 286. As noted above, the lattice structures 232 may have any suitable configuration.

The integrated exhaust system apparatus 190 depicted in FIGS. 4-13 is merely one possible configuration of an exhaust apparatus that may be incorporated into the power system 108. The views of FIGS. 14 and 15 depict a further example integrated exhaust system apparatus 298 in which FIG. 14 depicts an isometric view and FIG. 15 depicts a cross-sectional view.

Figure 14:
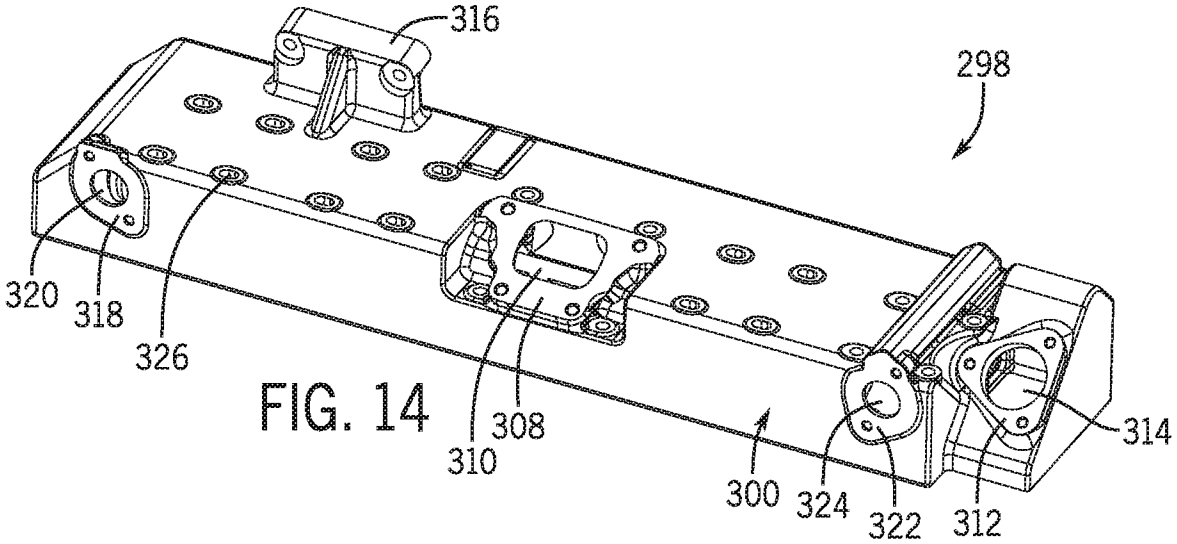
FIG. 14 is an isometric view of an integrated exhaust system apparatus of the power system of FIG. 3 in accordance with a further example embodiment.
Figure 15:
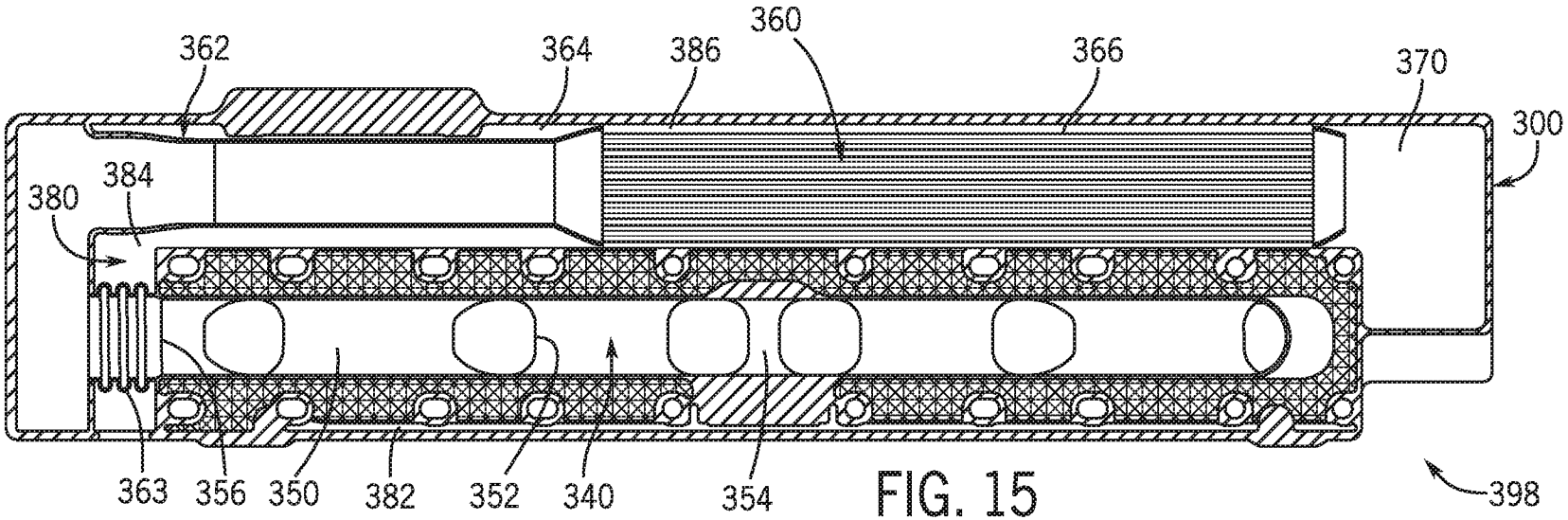
FIG. 15 is a cross-sectional view of the integrated exhaust system apparatus of FIG. 14 in accordance with the further example embodiment.

Similar to the embodiments discussed above, the integrated exhaust system apparatus 298 of FIGS. 14 and 15 includes a housing 300 with a number of walls that define an exhaust system interface 308, an EGR interface 312, a low pressure turbocharger interface flange 316, a coolant inlet interface 318, a coolant outlet interface 322, and one or more mounting structures 326. The exhaust system interface 308 includes a first exhaust apparatus outlet 310; the EGR interface 312 includes a second exhaust apparatus outlet 314; the coolant inlet interface 318 includes a coolant inlet 320; and the coolant outlet interface 322 includes coolant outlet 324. Generally, these aspects perform similar functions to those discussed above. In this embodiment, however, the EGR interface 312 and the second exhaust apparatus outlet 314 are positioned on a different housing wall (e.g., an end wall) as compared to the embodiment of FIGS. 4-13.

Now referring to FIG. 15, the apparatus 298 includes an exhaust manifold 340 and an EGR cooler 360 that function similar to corresponding components described above. In this embodiment, an EGR hot side conduit 362 is U-shaped with a first end 363 on the end of the exhaust manifold 340 and a second end 364 at the inlets of the EGR cooler 360. Compared to the embodiment of FIGS. 4-13, the embodiment of FIGS. 14 and 15 may have a longer overall length, but modified exhaust flow characteristics. As above, the EGR cooler 360 is formed from a number of passages 366 that extend between the EGR hot side conduit 362 and the EGR cool side conduit 370 that, in turn, is fluidly coupled to the second exhaust apparatus outlet 314.

Also as above, the apparatus 298 includes a cooling circuit 380 with various coolant cavities 382, 384, 386. The coolant cavities include a first coolant cavity 382 surrounding the exhaust manifold 340, a second coolant cavity 384 surrounding the EGR hot side conduit 362, and a third coolant cavity 386 surrounding the passages 366 within the EGR cooler 360.

Accordingly, during operation, exhaust from the engine 120 is forced out of the cylinders and into the exhaust system apparatus 298. The exhaust system apparatus 298 may have an inlet port 352 for each of the cylinders such that the exhaust manifold 340 receives the exhaust. A first portion of the exhaust in the manifold 340 flows out of the first manifold outlet 354 and into a high pressure turbocharger mounted on the apparatus 298. The second portion of the exhaust in the manifold 340 flows out of the second manifold outlet 356 as EGR exhaust, and subsequently flows through the EGR hot side conduit 362 and into the EGR cooler 360. From the EGR cooler 360, the second portion of the exhaust flows through the EGR cool side conduit 370 and out of the apparatus 298 via the second exhaust outlet 314 as cooled recirculation exhaust to be recirculated back into the engine.

The integrated exhaust apparatuses described above may be manufactured in any suitable manner, including additive manufacturing techniques such as direct metal laser fusion (or sintering) (DMLF or DMLS), selective laser sintering (SLS), electron beam melting (EBM), micro-pen deposition, laser wire deposition, electron beam melting, laser engineered net shaping, and direct metal deposition. For example, the DMLF process may be initialized with the creation of a model designed with computer aided design (CAD) software with three-dimensional ("3D") numeric coordinates of the entire configuration of the apparatus, including both external and internal surfaces.

During fabrication, a bed or deposit of build material is provided to form a working plane in a fabrication device or printer. A laser emits a laser beam, directed by the scanner, onto the build material in the working plane to selectively fuse the build material into a cross-sectional layer of the article according to the design. More specifically, the speed, position, and other operating parameters of the laser beam are controlled to selectively fuse the powder of the build material into larger structures by rapidly melting the powder particles to melt or diffuse into the solid structure below, and subsequently, cool and re-solidify. As such, based on the control of the laser beam, each layer of build material may include unfused and fused build material that respectively corresponds to the cross-sectional passages and walls that form the article. Upon completion of a respective layer, a fabrication support is lowered and/or the delivery support is raised such that the partially formed apparatus is positioned in a bed of build material as the successive layers are formed to support subsequent layers. This process is continued according to the modeled design as successive cross-sectional layers are formed into the completed apparatus described herein. The apparatus may be fabricated as a single, integral unit.

As a general matter, the build material may be formed by any suitable powder, including powdered metals, such as a stainless steel powder, and powdered alloys and super alloy materials, such as nickel-based or cobalt superalloys. In one exemplary embodiment, the build material is a high temperature nickel-based super alloy such as Inconel (IN718). In other embodiments, MAR-M-247, IN738, titanium, aluminum, titanium-aluminide, or other suitable alloys may be employed. In other words, the apparatus may be formed by a combination of powered build material. The material may also be selected based on the intended function of the area being formed. In some embodiments, the apparatus may undergo finishing treatments. Finishing treatments may include, for example, aging, annealing, quenching, peening, polishing, hot isostatic pressing (HIP), or coatings. In addition, finishing treatments may include removal or machining of structures that are not desired in the final component or to final specifications.

Accordingly, embodiments discussed herein provides an integrated exhaust system apparatus for a vehicle power system in which an exhaust manifold and EGR cooler are integrated into a single housing with a common cooling circuit. The embodiments discussed above provide a significant reduction in space and cost relative to other designs, for example, by eliminating separate pipe assemblies and mounting structures. Moreover, embodiments may reduce or eliminate tolerance stack-ups between other system and acceptable external surface temperatures are achieved without requiring separate water jacket cooling. Additionally, the examples described above may enable the engine to operate at elevated temperatures to achieve improved fuel economy, even while maintaining or reducing emission levels of pollutants. In some examples, additive manufacturing processes may facilitate manufacturing of the apparatus, which may enable the avoidance of casting, multi-piece weld brazing and/or the assembly resources, sheet metal and or cast gas pipes, and cast or wrought bracketing. Generally, the embodiments above provide of example configurations and arrangements of power system and/or engine configurations. However, the description above is generally applicable to any type of engine and/or vehicle systems.

As will be appreciated by one skilled in the art, certain aspects of the disclosed subject matter may be embodied as a method, system (e.g., a work vehicle control system included in a work vehicle), or computer program product. Accordingly, certain embodiments may be implemented entirely as hardware, entirely as software (including firmware, resident software, micro-code, etc.) or as a combination of software and hardware (and other) aspects. Furthermore, certain embodiments may take the form of a computer program product on a computer-usable storage medium having computer-usable program code embodied in the medium.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the work vehicles and the control systems and methods described herein are merely exemplary embodiments of the present disclosure.

For the sake of brevity, conventional techniques related to work vehicle and engine operation, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

Conventional techniques related to signal processing, data transmission, signaling, control, and other functional aspects of the systems (and the individual operating components of the systems) may not be described in detail herein for brevity. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

In some examples, the power system, exhaust system, EGR system, and/or other systems associated with the vehicle may also include a controller that facilitates implementation of the functions described herein. The controller may be on-board, remote, or a combination thereof and further may be a considered a vehicle controller, an exhaust treatment system controller, and/or one or more dedicated controllers for one or more of the components discussed herein. Generally, the controller may include any suitable type of processor and memory containing instructions executable by the processor to carry out the various functions described herein. The controller may be configured as a hard-wired computing circuit (or circuits), a programmable circuit, a hydraulic controller, an electrical controller, an electro-hydraulic controller, or otherwise. As such, the controller may be configured to execute various computational and control functionality with respect to the exhaust treatment system. In some embodiments, the controller may be configured to receive input signals in various formats (e.g., as hydraulic signals, voltage signals, current signals, and so on) and to output command signals in various formats (e.g., as hydraulic signals, voltage signals, current signals, mechanical movements, and so on).

Any suitable computer usable or computer readable medium may be utilized. The computer usable medium may be a computer readable signal medium or a computer readable storage medium. A computer-usable, or computer-readable, storage medium (including a storage device associated with a computing device or client electronic device) may be, for example, but is not limited to, an electronic, magnetic, optical, electromagnetic, infrared, or semiconductor system, apparatus, or device, or any suitable combination of the foregoing. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device. In the context of this document, a computer-usable, or computer-readable, storage medium may be any tangible medium that may contain, or store a program for use by or in connection with the instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be non-transitory and may be any computer readable medium that is not a computer readable storage medium and that may communicate, propagate, or transport a program for use by or in connection with an instruction execution system, apparatus, or device.

Any flowchart and block diagrams in the figures, or similar discussion above, can illustrate the architecture, functionality, and operation of possible implementations of systems, methods and computer program products according to various embodiments of the present disclosure. In this regard, each block in the flowchart or block diagrams can represent a module, segment, or portion of code, which includes one or more executable instructions for implementing the specified logical function(s). It should also be noted that, in some alternative implementations, the functions noted in the block (or otherwise described herein) can occur out of the order noted in the figures. For example, two blocks shown in succession (or two operations described in succession) can, in fact, be executed substantially concurrently, or the blocks (or operations) can sometimes be executed in the reverse order, depending upon the functionality involved. It will also be noted that each block of any block diagram and/or flowchart illustration, and combinations of blocks in any block diagrams and/or flowchart illustrations, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Also, the following examples are provided, which are numbered for easier reference.

1. An integrated exhaust system apparatus configured to be mounted on an engine generating an exhaust, comprising: an apparatus housing including at least one apparatus housing wall defining an apparatus interior; an engine interface positioned in the at least one apparatus housing wall with at least one exhaust apparatus inlet configured to direct the exhaust from the engine through the at least one apparatus housing wall into the apparatus interior; an exhaust system interface positioned in the at least one apparatus housing wall with at least one first exhaust apparatus outlet configured to direct a first portion of the exhaust from the apparatus interior through the at least one apparatus housing wall; an EGR (exhaust gas recirculation) interface positioned in the at least one apparatus housing wall with at least one second exhaust apparatus outlet configured to direct a second portion of the exhaust from the apparatus interior through the at least one apparatus housing wall; an exhaust manifold arranged within the apparatus interior proximate to the at least one exhaust apparatus inlet, the exhaust manifold including a manifold wall defining a manifold interior configured to receive the exhaust from the at least one exhaust apparatus inlet, a first manifold outlet positioned within the manifold wall and configured to direct the first portion of the exhaust out of the manifold interior, wherein the first manifold outlet is fluidly coupled to the at least one first exhaust apparatus outlet, and a second manifold outlet within the manifold wall and configured to direct the second portion of the exhaust out of the manifold interior; and an EGR cooler arranged within the apparatus interior and including a plurality of EGR cooler exhaust passages with first EGR cooler exhaust passage ends fluidly coupled such that the EGR cooler exhaust passages receive the second portion of the exhaust and second EGR cooler exhaust passage ends fluidly coupled such that the second portion of the exhaust is directed out of the EGR cooler exhaust passages to be directed out of the apparatus housing via the at least one second exhaust apparatus outlet.

2. The integrated exhaust system apparatus of example 1, further comprising an EGR hot side conduit arranged within the apparatus interior and extending between the second exhaust manifold outlet and the first EGR cooler exhaust passage ends to fluidly couple the exhaust manifold to the EGR cooler.

3. The integrated exhaust system apparatus of example 2, wherein the EGR hot side conduit is generally L-shaped or generally U-shaped.

4. The integrated exhaust system apparatus of example 2, wherein the EGR hot side conduit has a first end coupled to the second exhaust manifold outlet and a second end coupled to the first EGR cooler exhaust passage ends, and wherein at least one of the first end or second end of the EGR hot side conduit is formed by a bellows structure.

5. The integrated exhaust system apparatus of example 1, further comprising an EGR cool side conduit arranged within the apparatus interior and extending between the second EGR cooler exhaust passage ends and the at least one second exhaust apparatus outlet.

6. The integrated exhaust system apparatus of example 1, further comprising a cooling circuit with a coolant inlet defined in the at least one apparatus housing wall, a coolant outlet defined in the at least one apparatus housing wall, and at least one coolant cavity within the apparatus interior forming a coolant flow path between the coolant inlet and the coolant outlet such that coolant flows into the apparatus housing via the coolant inlet, flows through the at least one coolant cavity, and flows out of the apparatus housing via the coolant outlet.

7. The integrated exhaust system apparatus of example 6, wherein the at least one coolant cavity includes a first coolant cavity surrounding at least a portion of the EGR cooler exhaust passages such that heat is transferred from the exhaust within EGR cooler exhaust passages into the coolant.

8. The integrated exhaust system apparatus of example 7, wherein the at least one coolant cavity further includes a second coolant cavity surrounding at least a portion of the EGR hot side conduit.

9. The integrated exhaust system apparatus of example 8, wherein the at least one coolant cavity further includes a third coolant cavity surrounding at least a portion of the exhaust manifold.

10. The integrated exhaust system apparatus of example 9, wherein the third coolant cavity at least partially extends between the manifold wall and the at least one apparatus housing wall to function as a heat shield for the exhaust manifold.

11. The integrated exhaust system apparatus of example 1, wherein at least a portion of the manifold wall is formed by a lattice structure configured to inhibit heat transfer from the exhaust within the manifold interior through the manifold wall.

12. The integrated exhaust system apparatus of example 1, wherein the at least one apparatus housing wall has an inner surface facing the apparatus interior and an outer surface opposite the inner surface, and wherein the apparatus housing forms a first turbocharger flange on the outer surface of the at least one apparatus housing wall at the exhaust system interface, the first turbocharger flange defining a first mounting surface configured to receive a first turbocharger.

13. The integrated exhaust system apparatus of example 12, wherein the apparatus housing forms a second turbocharger flange on the outer surface of the at least one apparatus housing wall that defines a second mounting surface configured to receive a second turbocharger.

14. The integrated exhaust system apparatus of example 1, wherein the at least one apparatus housing wall defines a plurality of mounting through-holes configured to receive fasteners to mount the apparatus housing to the engine.

15. The integrated exhaust system apparatus of example 1, wherein at least the apparatus housing, the exhaust manifold, and the EGR cooler are formed with additive manufacturing.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. An integrated exhaust system apparatus configured to be mounted on an engine generating an exhaust, comprising:

an apparatus housing including at least one apparatus housing wall defining an apparatus interior and mounting structures for mounting the apparatus housing to the engine;

an engine interface positioned in the at least one apparatus housing wall with a plurality of exhaust apparatus inlets configured to direct the exhaust from cylinders of the engine directly through the at least one apparatus housing wall into the apparatus interior;

an exhaust system interface positioned in the at least one apparatus housing wall with at least one first exhaust apparatus outlet configured to direct a first portion of the exhaust from the apparatus interior through the at least one apparatus housing wall;

an EGR (exhaust gas recirculation) interface positioned in the at least one apparatus housing wall with at least one second exhaust apparatus outlet configured to direct a second portion of the exhaust from the apparatus interior through the at least one apparatus housing wall;

an exhaust manifold arranged within the apparatus interior proximate to the exhaust apparatus inlets and extending along a manifold longitudinal axis, the exhaust manifold including:

a manifold wall defining a plurality of inlet ports arranged in a line parallel to the manifold longitudinal axis and a manifold interior configured to receive the exhaust from the exhaust apparatus inlets, each of the inlet ports corresponding to one of the cylinders of the engine, a first manifold outlet within the manifold wall opening to all the plurality of inlet ports and configured to direct the first portion of the exhaust out of the manifold interior, wherein the first manifold outlet is fluidly coupled to the at least one first exhaust apparatus outlet, the first manifold outlet being arranged approximately in a center portion of the exhaust manifold along the manifold longitudinal axis such that that first portion of the exhaust flows out of the manifold interior approximately perpendicular to the manifold longitudinal axis, and a second manifold outlet within the manifold wall opening to all the plurality of inlet ports and configured to direct the second portion of the exhaust out of the manifold interior, the second manifold outlet being arranged proximate to a first end of the exhaust manifold along the manifold longitudinal axis;

an EGR cooler arranged within the apparatus interior and including a plurality of EGR cooler exhaust passages with first EGR cooler exhaust passage ends fluidly coupled such that the EGR cooler exhaust passages receive the second portion of the exhaust and second EGR cooler exhaust passage ends fluidly coupled such that the second portion of the exhaust is directed out of the EGR cooler exhaust passages to be directed out of the apparatus housing via the at least one second exhaust apparatus outlet; and an EGR hot side conduit arranged within the apparatus interior and extending between the second exhaust manifold outlet and the first EGR cooler exhaust passage ends to fluidly couple the exhaust manifold to the EGR cooler, the EGR cooler exhaust passages being arranged generally parallel to the manifold longitudinal axis such that the second portion of exhaust is directed from one or more of the cylinders of the engine through the exhaust manifold at approximately 180° into the EGR cooler exhaust passages via the second manifold housing outlet and the EGR hot side conduit.

2. The integrated exhaust system apparatus of claim 1, wherein the EGR hot side conduit is generally L-shaped.

3. The integrated exhaust system apparatus of claim 1, wherein the EGR hot side conduit is generally U-shaped.

4. The integrated exhaust system apparatus of claim 1, wherein the EGR hot side conduit has a first end coupled to the second exhaust manifold outlet and a second end coupled to the first EGR cooler exhaust passage ends, and wherein at least one of the first end or second end of the EGR hot side conduit is formed by a bellows structure.

5. The integrated exhaust system apparatus of claim 1, further comprising an EGR cool side conduit arranged within the apparatus interior and extending between the second EGR cooler exhaust passage ends and the at least one second exhaust apparatus outlet.

6. The integrated exhaust system apparatus of claim 1, further comprising a cooling circuit with a coolant inlet defined in the at least one apparatus housing wall, a coolant outlet defined in the at least one apparatus housing wall, and at least one coolant cavity within the apparatus interior forming a coolant flow path between the coolant inlet and the coolant outlet such that coolant flows into the apparatus housing via the coolant inlet, flows through the at least one coolant cavity, and flows out of the apparatus housing via the coolant outlet.

7. The integrated exhaust system apparatus of claim 6, wherein the at least one coolant cavity includes a first coolant cavity surrounding at least a portion of the EGR cooler exhaust passages such that heat is transferred from the exhaust within EGR cooler exhaust passages into the coolant.

8. The integrated exhaust system apparatus of claim 7, wherein the at least one coolant cavity further includes a second coolant cavity surrounding at least a portion of the EGR hot side conduit.

9. The integrated exhaust system apparatus of claim 8, wherein the at least one coolant cavity further includes a third coolant cavity surrounding at least a portion of the exhaust manifold.

10. The integrated exhaust system apparatus of claim 9, wherein the third coolant cavity at least partially extends between the manifold wall and the at least one apparatus housing wall to function as a heat shield for the exhaust manifold.

11. The integrated exhaust system apparatus of claim 1, wherein at least a portion of the manifold wall is formed by a lattice structure configured to inhibit heat transfer from the exhaust within the manifold interior through the manifold wall.

12. The integrated exhaust system apparatus of claim 1, wherein the at least one apparatus housing wall has an inner surface facing the apparatus interior and an outer surface opposite the inner surface, and wherein the apparatus housing forms a first turbocharger flange on the outer surface of the at least one apparatus housing wall at the exhaust system interface, the first turbocharger flange defining a first mounting surface configured to receive a first turbocharger.

13. The integrated exhaust system apparatus of claim 12, wherein the apparatus housing forms a second turbocharger flange on the outer surface of the at least one apparatus housing wall that defines a second mounting surface configured to receive a second turbocharger.

14. The integrated exhaust system apparatus of claim 1, wherein the mounting structures include a plurality of mounting through-holes configured to receive fasteners to mount the apparatus housing to the engine.

15. The integrated exhaust system apparatus of claim 1, wherein at least the apparatus housing, the exhaust manifold, and the EGR cooler are formed with additive manufacturing.

16. An engine arrangement, comprising:

an engine configured to generate exhaust;

an integrated exhaust system apparatus mounted to the engine and including:

an apparatus housing including at least one apparatus housing wall defining an apparatus interior and a plurality of mounting structures for mounting the apparatus housing directly to the engine;

an engine interface positioned in the at least one apparatus housing wall with a plurality of exhaust apparatus inlets configured to direct the exhaust from cylinders of the engine directly through the at least one apparatus housing wall into the apparatus interior;

an exhaust system interface positioned in the at least one apparatus housing wall with at least one first exhaust apparatus outlet configured to direct a first portion of the exhaust from the apparatus interior through the at least one apparatus housing wall;

an EGR (exhaust gas recirculation) interface positioned in the at least one apparatus housing wall with at least one second exhaust apparatus outlet configured to direct a second portion of the exhaust from the apparatus interior through the at least one apparatus housing wall;

an exhaust manifold arranged within the apparatus interior proximate to the exhaust apparatus inlets and extending along a manifold longitudinal axis, the exhaust manifold including a manifold wall defining a plurality of inlet ports arranged in a line parallel to the manifold longitudinal axis and a manifold interior configured to receive the exhaust from the exhaust apparatus inlets, each of the inlet ports corresponding to one of the cylinders of the engine, a first manifold outlet within the manifold wall opening to all the plurality of inlet ports and configured to direct the first portion of the exhaust out of the manifold interior, wherein the first manifold outlet is fluidly coupled to the at least one first exhaust apparatus outlet, the first manifold outlet being arranged approximately in a center portion of the exhaust manifold along the manifold longitudinal axis such that that first portion of the exhaust flows out of the manifold interior approximately perpendicular to the manifold longitudinal axis, and a second manifold outlet within the manifold wall opening to all the plurality of inlet ports and configured to direct the second portion of the exhaust out of the manifold interior; and an EGR cooler arranged within the apparatus interior and including a plurality of EGR cooler exhaust passages with first EGR cooler exhaust passage ends fluidly coupled such that the EGR cooler exhaust passages receive the second portion of the exhaust and second EGR cooler exhaust passage ends fluidly coupled such that the second portion of the exhaust is directed out of the EGR cooler exhaust passages to be directed out of the apparatus housing via the at least one second exhaust apparatus outlet;

an EGR hot side conduit arranged within the apparatus interior and extending between the second exhaust manifold outlet and the first EGR cooler exhaust passage ends to fluidly couple the exhaust manifold to the EGR cooler, the EGR cooler exhaust passages being arranged generally parallel to the manifold longitudinal axis such that the second portion of exhaust is directed from one or more of the cylinders of the engine through the exhaust manifold at approximately 180° into the EGR cooler exhaust passages via the second manifold housing outlet and the EGR hot side conduit;

a first turbocharger mounted to the integrated exhaust system apparatus and fluidly coupled to the at least one first exhaust apparatus outlet to receive the first portion of the exhaust; and an EGR system extending between the at least one second exhaust apparatus outlet and the engine to direct the second portion of the exhaust from the integrated exhaust system apparatus to the engine.

17. The engine arrangement of claim 16, further comprising a cooling circuit with a coolant inlet defined in the at least one apparatus housing wall, a coolant outlet defined in the at least one apparatus housing wall, and at least one coolant cavity forming a coolant flow path between the coolant inlet and the coolant outlet such that coolant flows into the apparatus housing via the coolant inlet, flows through the at least one coolant cavity, and flows out of the apparatus via the coolant outlet, wherein the at least one coolant cavity includes:

a first coolant cavity surrounding at least a portion of the EGR cooler exhaust passages such that heat is transferred from the exhaust within EGR cooler exhaust passages into the coolant, a second coolant cavity surrounding at least a portion of the EGR hot side conduit, a third coolant cavity surrounding at least a portion of the exhaust manifold.

18. The engine arrangement of claim 16, wherein at least the apparatus housing, the exhaust manifold, and the EGR cooler are formed with additive manufacturing.

* * * * *